US012465119B2

(12) United States Patent
Sagara et al.

(10) Patent No.: US 12,465,119 B2
(45) Date of Patent: Nov. 11, 2025

(54) POLYESTER FABRIC HOOK-AND-LOOP FASTENER AND MANUFACTURING METHOD FOR SAME

(71) Applicant: Kuraray Fastening Co., Ltd., Osaka (JP)

(72) Inventors: Makoto Sagara, Sakai (JP); Yoshikatsu Fujisawa, Sakai (JP); Nobuhiro Koga, Kurashiki (JP)

(73) Assignee: Kuraray Fastening Co., Ltd., Osaka (JP)

( * ) Notice: Subject to any disclaimer, the term of this patent is extended or adjusted under 35 U.S.C. 154(b) by 102 days.

(21) Appl. No.: 18/251,500

(22) PCT Filed: Nov. 1, 2021

(86) PCT No.: PCT/JP2021/040187
§ 371 (c)(1),
(2) Date: May 2, 2023

(87) PCT Pub. No.: WO2022/097593
PCT Pub. Date: May 12, 2022

(65) Prior Publication Data

US 2024/0000198 A1 Jan. 4, 2024

(30) Foreign Application Priority Data

Nov. 6, 2020 (JP) ..... 2020-185629

(51) Int. Cl.
*A44B 18/00* (2006.01)
*D03D 1/00* (2006.01)
(Continued)

(52) U.S. Cl.
CPC ..... *A44B 18/0034* (2013.01); *A44B 18/0057* (2013.01); *D03D 1/00* (2013.01);
(Continued)

(58) Field of Classification Search
CPC ..... A44B 18/0034; A44B 18/0057; A44B 18/0088
See application file for complete search history.

(56) References Cited

U.S. PATENT DOCUMENTS

2005/0081341 A1* 4/2005 McDougall ..... A44B 18/0034 24/445
2008/0289157 A1* 11/2008 Higashinaka ..... A44B 18/0023 139/420 R
(Continued)

FOREIGN PATENT DOCUMENTS

JP 2014-27989 2/2014
JP 2015-62599 4/2015
(Continued)

OTHER PUBLICATIONS

English Translation of the International Searching Authority of PCT/JP2021/040187 (Year: 2021).*
(Continued)

*Primary Examiner* — Elizabeth M Imani
(74) *Attorney, Agent, or Firm* — Grüneberg and Myers PLLC

(57) ABSTRACT

A polyester woven-fabric hook-and-loop fastener has a warp yarn thickness Tb which is 0.94 times or less of a warp yarn thickness Ts. A selvage area having a constant width is present on two opposite ends, continuously in a line form in the warp direction, without misalignment in the weft direction. As a result, when the polyester woven-fabric hook-and-loop fastener is sewn onto a garment or the like, a sewing thread sewn to the selvage area is in a straight line without meandering, and thus a sewn product excellent in appearance can be obtained.

16 Claims, 2 Drawing Sheets

(51) Int. Cl.

| | |
|---|---|
| ***D03D 5/00*** | (2006.01) |
| ***D03D 13/00*** | (2006.01) |
| ***D03D 15/283*** | (2021.01) |
| ***D03D 15/47*** | (2021.01) |
| ***D03D 15/587*** | (2021.01) |
| ***D03D 27/06*** | (2006.01) |
| ***D06C 7/00*** | (2006.01) |
| ***D06C 13/08*** | (2006.01) |
| ***D06C 15/00*** | (2006.01) |

(52) U.S. Cl.
CPC ..... *D03D 5/00* (2013.01); *D03D 13/008* (2013.01); *D03D 15/283* (2021.01); *D03D 15/47* (2021.01); *D03D 15/587* (2021.01); *D03D 27/06* (2013.01); *D06C 7/00* (2013.01); *D06C 13/08* (2013.01); *D06C 15/00* (2013.01); *D10B 2331/04* (2013.01); *D10B 2501/063* (2013.01)

(56) References Cited

U.S. PATENT DOCUMENTS

| | | | | |
|---|---|---|---|---|
| 2018/0014611 | A1* | 1/2018 | Kaiko | A44B 18/0088 |
| 2018/0073169 | A1 | 3/2018 | Chou | |

FOREIGN PATENT DOCUMENTS

| | | |
|---|---|---|
| JP | 2016-16200 | 2/2016 |
| JP | 3214172 U | 12/2017 |
| WO | 2005/122817 | 12/2005 |
| WO | 2007/074791 | 7/2007 |
| WO | 2020/153160 | 7/2020 |

OTHER PUBLICATIONS

WO2014049940A1 (Year: 2014).*
European Search Report dated Jul. 19, 2024, in European Application No. 21889146.3, 4 pages.
International Search Report issued Dec. 7, 2021, in PCT/JP2021/040187, with English translation 5 pages.
Written Opinion issued Dec. 7, 2021, in PCT/JP2021/040187, with English translation, 10 pages.

* cited by examiner

[Fig. 1]
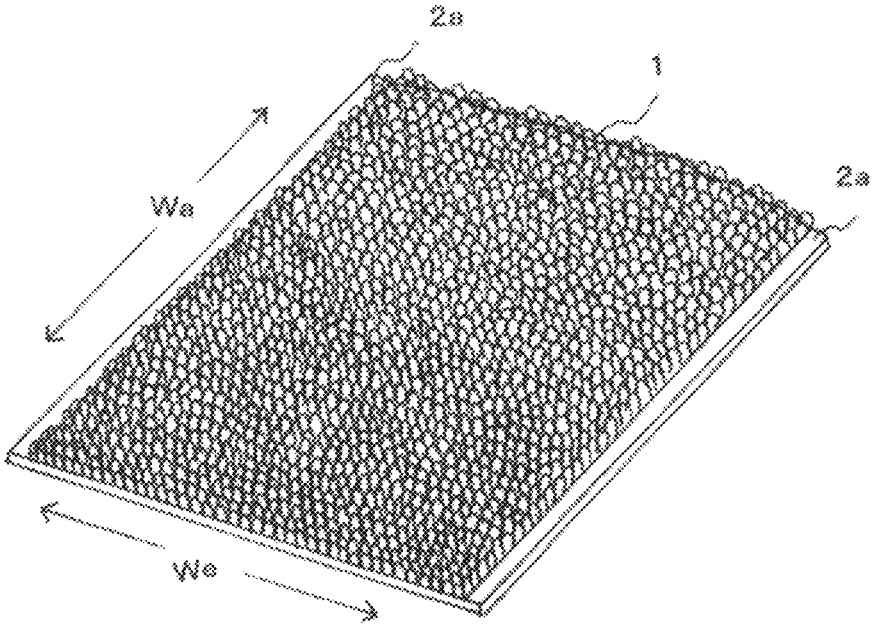
[Fig. 2]
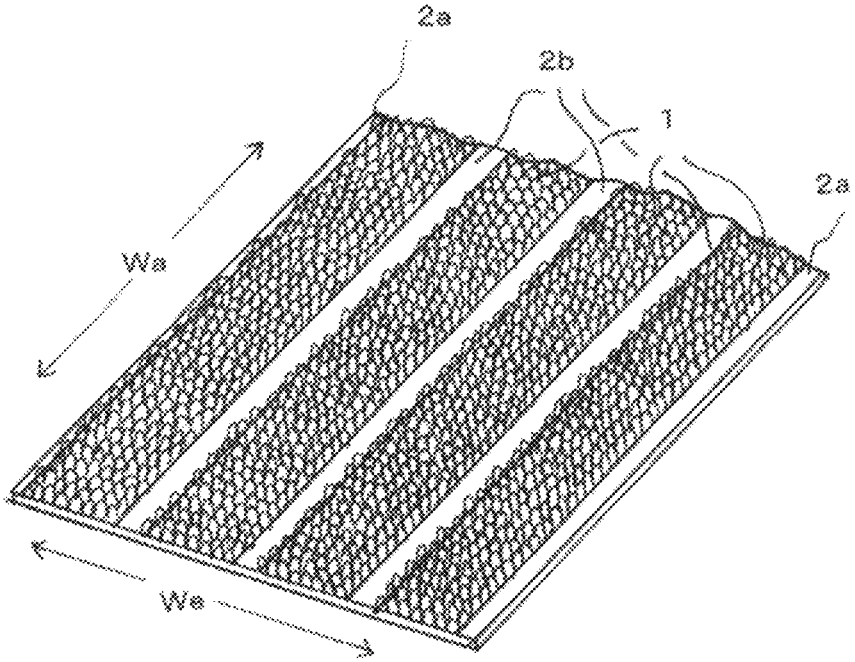

[Fig. 3]
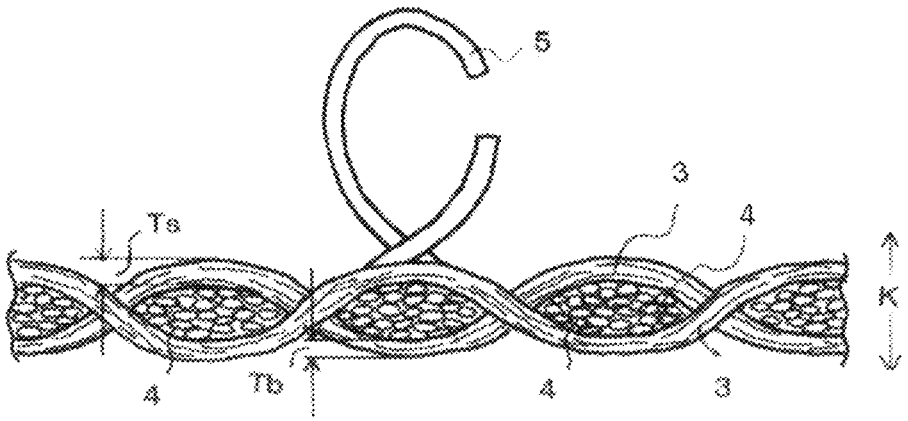
[Fig. 4]
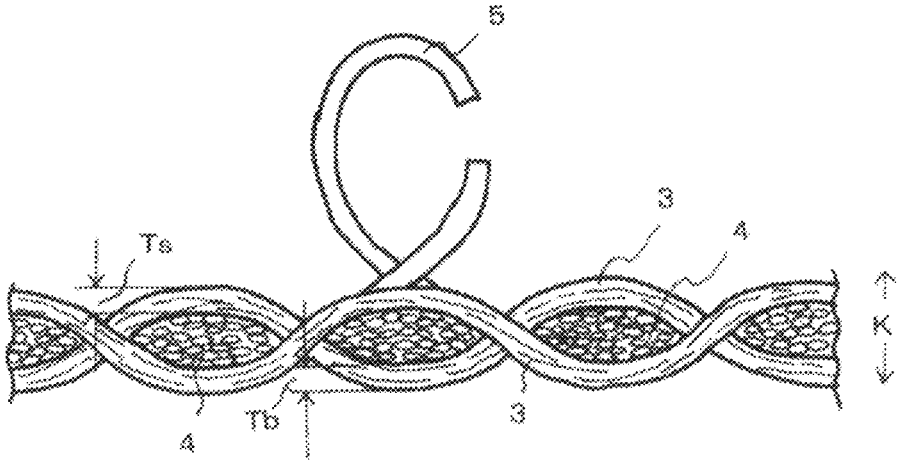
[Fig. 5]
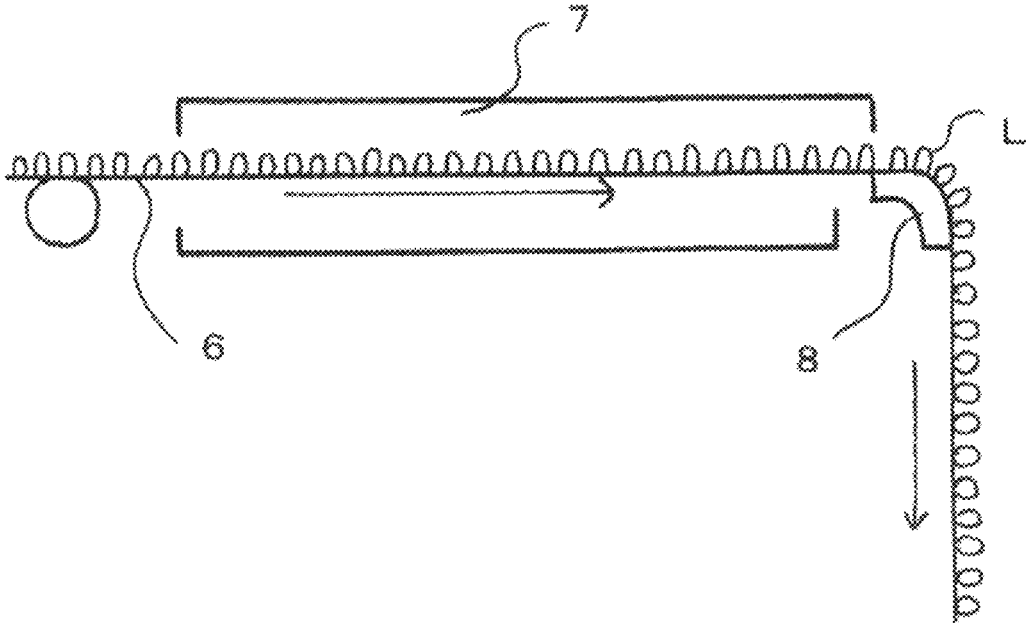

POLYESTER FABRIC HOOK-AND-LOOP FASTENER AND MANUFACTURING METHOD FOR SAME

CROSS-REFERENCE TO RELATED APPLICATIONS

This application is the National Stage entry under § 371 of International Application No. PCT/JP2021/040187, filed on Nov. 1, 2021, and which claims the benefit of priority to Japanese Patent Application No. 2020-185629, filed on Nov. 6, 2020. The content of each of these applications is hereby incorporated by reference in its entirety.

TECHNICAL FIELD

The present invention relates to a woven-fabric hook-and-loop fastener formed of a polyester fiber and having hook-shaped engaging elements and/or loop-shaped engaging elements, the woven-fabric hook-and-loop fastener being obtained by fixing a yarn for engaging elements to a woven base fabric for the hook-and-loop fastener through fusion of a heat-fusible fiber which is used as a weft yarn.

BACKGROUND ART

A conventionally known hook-and-loop fastener having a woven base fabric is a combination of a so-called woven-fabric-type hook hook-and-loop fastener which has a number of hook-shaped engaging elements formed of a monofilament yarn on a front surface of a woven base fabric and a so-called woven-fabric-type loop hook-and-loop fastener which can engage with the hook-shaped engaging element and which has a number of loop-shaped engaging elements formed of a multifilament yarn on a front surface of a woven base fabric. A woven-fabric-type hook hook-and-loop fastener and a woven-fabric-type loop hook-and-loop fastener do not undergo damage of the engaging elements even after repeated engagement/peeling operations, leading to less reduction in the engaging force, and thus, such a faster is widely used in the fields of applications, such as clothing and everyday sundries.

A so-called hook/loop coexisting woven-fabric hook-and-loop which has both of a number of the hook-shaped engaging elements and a number of the loop-shaped engaging elements on a front surface of a woven base fabric is also widely used since one hook-and-loop fastener has both the functions of a hook hook-and-loop fastener and a loop hook-and-loop fastener.

In the case of such a woven-fabric hook-and-loop fastener, in order to prevent pulling of the yarn for engaging elements sewn into a woven base fabric formed of a warp yarn and a weft yarn out of the woven base fabric by pulling in peeling the engagement, a urethane-based or acrylic resin agent referred to as a back coating adhesive is generally applied on the rear surface of the woven base fabric.

However, a conventional hook-and-loop fastener provided with a back coating adhesive layer tends to be stiff because of reduced softness of the woven base fabric due to the back coating adhesive layer present on the rear surface, unfortunately leading to reduction in the texture. In addition, the adhesive is likely to degrade in use as a hook-and-loop fastener and the fixing force of the yarn for engaging elements gradually decreases, unfortunately leading to reduction in the engaging function of the hook-and-loop fastener. Furthermore, due to the back coating adhesive layer present on the rear surface of the woven base fabric, the air permeability of the hook-and-loop fastener unfortunately decreases.

Moreover, in a woven-fabric hook-and-loop fastener having a back coating adhesive applied on a woven base fabric rear surface, a dyeing liquid cannot pass through the woven base fabric due to the back coating adhesive layer, and thus even dyeing with a dark color cannot be achieved. Accordingly, dyeing is to be applied before application of the back coating adhesive. Before application of the back coating adhesive, the yarn for engaging elements and the like are not fixed on the woven base fabric yet, and thus, yarns constituting the woven base fabric move by the dyeing treatment to cause misalignment or the like, and the alignment of the engaging elements is disordered. In the case of hook-shaped engaging elements, when the alignment of the engaging elements is disordered, in cutting one leg of each of loops for hook-shaped engaging element to form hook-shaped engaging elements, it is difficult to securely cut only one leg, and both legs are cut or no leg is cut in many cases.

As a hook-and-loop fastener that solves the problem of such a hook-and-loop fastener having a back coating adhesive applied on the rear surface thereof, PTL 1 discloses a hook-and-loop fastener in which a polyester-type thermal shrinkable yarn is used as a warp yarn, a weft yarn, and a yarn for engaging elements, a heat-fusible fiber is further used as a yarn constituting the weft yarn, and the yarn for engaging elements is fixed onto a woven base fabric by fusion of the heat-fusible fiber and by thermal shrinkage of the yeans constituting the hook-and-loop fastener.

In addition, PTL 2 discloses a self-fused loop hook-and-loop fastener in which, on one surface of a woven base fabric formed of a polyester weft yarn and a polyester warp yarn, a number of loop-shaped engaging elements formed of a polyester yarn for loop-shaped engaging elements woven in parallel to the warp yarn rise up, and the roots of the loop-shaped engaging elements are fixed to the woven base fabric by fusion of a heat-fusible fiber used as a weft yarn and by thermal shrinkage of the yarns constituting the hook-and-loop fastener.

In general, a selvage having no engaging elements is provided on two opposite ends of a woven-fabric hook-and-loop fastener, and using the selvage, the woven-fabric hook-and-loop fastener is attached by sewing onto everyday sundries, such as garments, globes, shoes, and bags. As a method of producing such a woven-fabric hook-and-loop fastener having selvages, a method is used in which, in weaving a base fabric for hook-and-loop fastener, a hook-and-loop fastener base fabric is woven so that a selvage area having no engaging elements is present continuously in the warp direction on each of two opposites ends parallel to the warp yarn on the base fabric front surface side.

In the case of the woven-fabric hook-and-loop fasteners disclosed in the above patent documents, since there is definitely no back coating adhesive layer, the disadvantage of a conventional hook-and-loop fastener provided with a back coating adhesive layer can be eliminated. However, on the other hand, in fixing the root of the yarn for engaging elements onto the woven base fabric by heat fusion of the weft yarn, the thermal shrinkage tends to be uneven, often resulting in misalignment of the warp yarn in the weft direction. When the misalignment occurs, misalignment of the selvage area in the weft direction also occurs, resulting in an uneven width of the selvage area or a curve of the selvage area in the warp direction. When the width of a selvage is uneven or a selvage curves, this gives an impression as if a sewing thread sewn into the selvage meanders when the selvage is attached by sewing onto a garment or the like, leading to reduction in the commercial value of the garment or the like.

In particular, in the case of a woven-fabric hook-and-loop fastener, it is preferred in terms of productivity that a wide base fabric for hook-and-loop fastener is woven and the wide hook-and-loop fastener base fabric is slitted in the warp direction to simultaneously produce two or more long hook-and-loop fasteners. In the case of such a production method, it is needed that, in the parts to be slitted, one area or two or more areas for forming selvage having no engaging elements, each of the areas being continuous in the warp direction, are present at intervals in the weft direction so that the area having loops for engaging element is divided into two or more parts by the area(s) for forming selvage.

However, when the warp yarn is misaligned in the weft direction, the area for forming selvage is also misaligned in the weft direction. In particular, when the area for forming selvage is misaligned in the weft direction, it is difficult to accurately slit the center of the area for forming selvage, and as a result, it is extremely difficult to obtain a long woven-fabric hook-and-loop fastener with selvage areas having a constant width. When the width of a selvage area is uneven, as described above, in attachment to a garment or the like by sewing, an impression as if the sewing thread sewn into the selvage area meanders is given, leading to reduction in the commercial value of the garment or the like.

As described above, hook-shaped engaging elements are produced by weaving a yarn for engaging elements into a woven base fabric in parallel to a warp yarn, allowing the yarn for engaging elements to rise up in a loop shape in a number of points from the woven base fabric to form loops for engaging element, and cutting one leg of each of the loops for engaging element. When the warp yarn is misaligned in the weft direction, the loops for engaging element are accordingly also misaligned in the weft direction, and it is difficult to accurately and securely cut only one leg of each loop. Thus, loops with both the legs cut, loops with no leg cut, loops with misaligned cutting points, and the like are present together, leading to reduction in the commercial value as a hook-and-loop fastener.

PTL 1 states that no crumple or deformation was found in the resulting woven-fabric hook-and-loop fastener, but has no statement about misalignment of the warp yarn in the weft direction. PTL 2 states that a 1-inch width woven-fabric hook-and-loop fastener having a selvage on each of two opposites ends is produced by weaving from the beginning, and thus a woven-fabric hook-and-loop fastener can be obtained without slitting in the warp direction. However, in the case of such a small width, misalignment, if occurs, is small and thus, the technique of PTL 2 rarely suffers from such a problem of an uneven selvage width due to misalignment of a selvage area in the weft direction.

CITATION LIST

Patent Literature

PTL 1: WO 2005/122817
PTL 2: WO 2007/074791

SUMMARY OF INVENTION

Technical Problem

The present invention relates to a technique for obtaining a woven-fabric hook-and-loop fastener that has a selvage area continuous in a warp direction on each of two opposites ends, and has an object to provide a long woven-fabric hook-and-loop fastener in which selvage areas are hardly misaligned in the weft direction, and as a result, selvage areas each having a constant width are present along the warp direction on two opposite ends.

In particular, the present invention relates to a technique for simultaneously obtaining two or more long woven-fabric hook-and-loop fasteners with selvages by slitting an area having no engaging elements (area for forming selvage) in the warp direction, the area for forming selvage being present continuously in the warp direction between selvage areas that are respectively present continuously in the warp direction on two opposite ends of a woven-fabric hook-and-loop fastener, and has an object to provide a technique for simultaneously obtaining two or more long woven-fabric hook-and-loop fasteners each having selvage areas with an even width by slitting an intermediate in the width direction of the area for forming selvage in the warp direction.

The present invention further has an object to obtain a woven-fabric hook-and-loop fastener dyed in an efficient and even manner in which selvage areas are each present in a straight line in the warp direction with an even width without misalignment even after dyeing.

The present invention also has an object to provide a hook woven-fabric hook-and-loop fastener or a hook/loop coexisting woven-fabric hook-and-loop fastener that has hook-shaped engaging elements in which only one leg of each of loops for hook-shaped engaging element is accurately and securely cut.

Solution to Problem

Specifically, the present invention provides

- a polyester woven-fabric hook-and-loop fastener including
  - a woven base fabric formed of a warp yarn and a weft yarn,
  - a yarn for engaging elements woven in parallel to the warp yarn of the base fabric, and
  - loop-shaped engaging elements, hook-shaped engaging elements, or both that are formed of the yarn for engaging elements and that rise up from a front surface of the base fabric,
- each of the warp yarn, the weft yarn, and the yarn for engaging elements being of a polyester fiber,
- the weft yarn containing a heat-fusible fiber,
- the engaging elements each being fused at a root thereof to the heat-fusible fiber to thus be fixed to the base fabric,
- the polyester woven-fabric hook-and-loop fastener satisfying requirements (1) and (2) described below:

(1) the warp yarn alternately runs over and under the weft yarn with the weft yarn interposed therebetween, and a thickness Tb thereof in a base fabric thickness direction at a point where the warp yarn is the most subducted toward a base fabric rear surface side is 0.94 times or less a thickness Ts thereof in the base fabric thickness direction at a point where the warp yarn is the most floated toward a base fabric front surface side, (2) a selvage area having no engaging elements is present continuously in a warp direction on each of two opposite ends parallel to the warp yarn on the base fabric front surface side.

Tb is preferably 0.92 times Ts or less, Tb is more preferably 0.7 to 0.88 times Ts.

In a preferred aspect of the polyester woven-fabric hook-and-loop fastener, between the two selvage areas which are present on the two opposite ends parallel to the warp yarn on the base fabric front surface side, an area for forming selvage having no engaging elements is present continuously in parallel to the warp direction, and an area having engaging elements is divided by the area for forming selvage into two or more areas parallel to the warp yarn.

In another preferred aspect of the polyester woven-fabric hook-and-loop fastener, the selvage forming area is slitted at the center in the width direction thereof in parallel to the warp yarn to provide a woven-fabric hook-and-loop fastener in which at least one of selvage areas present on two opposite ends is a selvage area derived from the selvage forming area.

In another preferred aspect of the polyester woven-fabric hook-and-loop fastener, no adhesive layer for fixing the engaging elements onto the base fabric is present on the base fabric rear surface.

In another preferred aspect of the polyester woven-fabric hook-and-loop fastener, the polyester woven-fabric hook-and-loop fastener is dyed with a disperse dye.

The present invention further provides a method of producing a polyester woven-fabric hook-and-loop fastener, the method including steps 1 to 3 described below to be performed in this order:

step 1:

a step of weaving a woven fabric for hook-and-loop fastener, the woven fabric including a woven base fabric formed of a warp yarn and a weft yarn, a yarn for engaging elements woven in parallel to the warp yarn of the base fabric, and a selvage area having no engaging elements, the selvage area being present on each of two opposite ends of a base fabric front surface and being present continuously in parallel to a warp direction, the yarn for engaging elements forming a number of loops for hook-shaped engaging element, loops for loop engaging element, or both that rise up from the base fabric front surface, each of the warp yarn, the weft yarn, and the yarn for engaging elements being of a polyester fiber, the weft yarn containing a heat-fusible fiber, step 2:

a heat treatment step of heating the woven fabric for hook-and-loop fastener in a heat treatment furnace to a temperature at which the heat-fusible fiber melts or higher to cause thermal shrinkage of a yarn constituting the woven fabric for hook-and-loop fastener while strongly fixing the yarn for engaging elements to the base fabric, step 3:

a step of taking the heat-treated woven fabric for hook-and-loop fastener out of the heat treatment furnace and pushing a rear surface of the base fabric against a fixed surface or a rolling surface in the state where the heat-fusible fiber remains molten.

In the production method, the steps 1 to 3 are preferably performed without winding on the way.

In a preferred aspect of the present invention, the step 3 is performed without pushing a front surface side of the base fabric against a fixed surface or a rolling surface.

In another preferred aspect of the present invention, when loops for hook-shaped engaging element are included, a step 4 described below is performed after the step 3, and the steps 1 to 4 are continuously performed without winding on the way.

step 4:

a step of cutting one leg of each of the loops for hook-shaped engaging element to form hook-shaped engaging elements.

In another preferred aspect of the present invention, in the step 1, a woven fabric for hook-and-loop fastener, in which an area for forming selvage having no engaging elements is formed between the selvage areas continuously in parallel to the warp direction and in which an area having engaging elements is divided into two or more areas parallel to the warp yarn by the area for forming selvage, was woven, and a step 5 described below is performed after the step 3 or after the step 4, if performed.

step 5:

a step of slitting the base fabric in parallel to the warp direction in the selvage area interposed between the areas having engaging elements.

In another preferred aspect of the present invention, the obtained long polyester-type hook-and-loop fastener is wound after completion of the step 4 when the step 4 is to be performed, or after completion of the step 3 when the step 4 is not to be performed, and in the wound state, the hook-and-loop fastener is immersed in a dyeing liquid containing a disperse dye to dye the hook-and-loop fastener, before the step 5, if to be performed.

Advantageous Effects of Invention

In the present invention, the woven base fabric is heated to a temperature at which the heat-fusible fiber melts or higher to cause thermal shrinkage of yarns constituting the woven base fabric, and then, an operation of pushing the rear surface of the woven base fabric against a fixed surface or a rolling surface is performed in the state where the heat-fusible fiber remains molten. By this operation, misalignment in the weft direction of the selvage areas present on two opposite ends is corrected. When the area for forming selvage is included, misalignment in the weft direction of the area for forming selvage is corrected. As a result, a long woven-fabric hook-and-loop fastener in which a selvage area having a constant width is present continuously in a straight line in the warp direction on each of two opposite ends can be obtained. When the area for forming selvage is included, by slitting the area for forming selvage at the center in the width direction in the warp direction, a long woven-fabric hook-and-loop fastener having selvage areas having a constant width present in a straight-line form can be obtained. The area for forming selvage can be accurately slitted in the warp direction at the center in the width direction, whereby two or more long woven-fabric hook-and-loop fasteners having selvage areas having an even width can be simultaneously obtained.

In addition, by pushing the rear surface of the woven base fabric against a fixed surface or a rolling surface, misalignment in the weft direction of the yarn for engaging elements is corrected in the same manner, and a hook woven-fabric hook-and-loop fastener having hook-shaped engaging elements in which only one leg of each of loops for hook-shaped engaging element is accurately and securely cut can be obtained.

In the present invention, the yarns constituting the base fabric is thermally shrunk while melting the heat-fusible fiber used in the weft yarn, and then, in the state where the heat-fusible fiber remains molten, an operation of pushing the rear surface of the base fabric against a fixed surface or a rolling surface is performed. By this operation, a thickness in the base fabric thickness direction of the warp yarn, which alternately runs over and under the weft yarn with the weft yarn interposed therebetween, at a point where the warp yarn is the most subducted toward the rear surface side is 0.94 times or less the thickness thereof at a point where the warp yarn is the most floated toward the front surface side. By satisfying the thickness relationship of the warp yarn, the above effect can be obtained.

Furthermore, a woven-fabric hook-and-loop fastener having an area for forming selvage is wound in the state with a large width before slitting. By placing the woven-fabric hook-and-loop fastener wound with a large width in a dyeing pot to immerse the woven-fabric hook-and-loop fastener in a dyeing liquid, and circulating the dye liquid, the dye liquid uniformly passed through the hook-and-loop fastener, and a wide woven-fabric hook-and-loop fastener dyed without uneven dyeing can be obtained. By slitting the area for forming selvage of the dyed wide woven-fabric hook-and-loop fastener at the center in the width direction in the warp direction, two or more dyed woven-fabric hook-and-loop fasteners can be obtained at once in an efficient manner.

By performing an operation of pushing the rear surface of the base fabric against a fixed surface or a rolling surface in the state where the heat-fusible fiber remains molten, the thickness in the base fabric thickness direction of the warp yarn satisfies the above relationship, and in comparison with the case where the relationship is not satisfied, a local strain of the warp yarn or weft yarn is corrected, and in particular, misalignment in the weft direction of the warp yarn and the yarn for engaging elements is corrected.

BRIEF DESCRIPTION OF DRAWINGS

FIG. 1 is a perspective view schematically illustrating an example of the polyester woven-fabric hook-and-loop fastener of the present invention (a case having selvage areas but not having an area for forming selvage).

FIG. 2 is a perspective view schematically illustrating another example of the polyester woven-fabric hook-and-loop fastener (a case having both selvage areas and areas for forming selvage).

FIG. 3 is a schematic diagram of a cross section parallel to the warp yarn of the polyester woven-fabric hook-and-loop fastener of the present invention.

FIG. 4 is a schematic diagram of a cross section parallel to the warp yarn of the polyester woven-fabric hook-and-loop fastener of the present invention produced without performing the step 3.

FIG. 5 is a schematic diagram of an example of a heat treatment apparatus to be used in production of the polyester woven-fabric hook-and-loop fastener of the present invention.

DESCRIPTION OF EMBODIMENTS

Next, the polyester woven-fabric hook-and-loop fastener of the present invention and a production method thereof will be described in detail.

The polyester woven-fabric hook-and-loop fastener of the present invention may be any of a hook woven-fabric hook-and-loop fastener having a number of hook-shaped engaging elements on a front surface of a woven base fabric, a loop woven-fabric hook-and-loop fastener having a number of loop-shaped engaging elements on a front surface of a woven base fabric, and a hook/loop coexisting woven-fabric hook-and-loop fastener having both of a number of hook-shaped engaging elements and a number of loop-shaped engaging elements on a front surface of a woven base fabric.

The hook woven-fabric hook-and-loop fastener is mainly formed of a monofilament yarn for hook-shaped engaging elements, a warp yarn, and a weft yarn. On the other hand, the loop woven-fabric hook-and-loop fastener which is to be a counterpart of the hook woven-fabric hook-and-loop fastener is mainly formed of a multifilament yarn for loop-shaped engaging elements, a warp yarn, and a weft yarn. The hook/loop coexisting woven-fabric hook-and-loop fastener in which hook-shaped engaging elements and loop-shaped engaging elements coexist on the same surface is mainly formed of a monofilament yarn for hook-shaped engaging elements, a multifilament yarn for loop-shaped engaging elements, a warp yarn, and a weft yarn. In the woven-fabric hook-and-loop fasteners, a yarn other the above may be woven, as required.

Each of the warp yarn, the weft yarn, and the yarn for engaging elements is to be substantially constituted of a polyester-type polymer, in terms of not causing waviness (the state where a base fabric surface of a woven-fabric hook-and-loop fastener is irregularly up and down and is not a horizontal plane) by heat, water absorption, or moisture absorption, furthermore, since threads are then strongly bonded to each other by heat fusion.

Polyester-type polymer is a polyester mainly having an ethylene terephthalate unit or a polyester mainly having a butylene terephthalate unit, the polyester being obtained mainly by a polycondensation reaction of terephthalic acid and ethylene glycol or a polycondensation reaction of terephthalic acid and butanediol. A small amount of a polymerization unit other than terephthalic acid and ethylene glycol or other than terephthalic acid and butanediol may be added. Furthermore, a small amount of a polymer other than the above may be added to the polyester.

The warp yarn and the yarn for engaging elements are preferably formed mainly of a polyethylene terephthalate-based homopolymer or a polybutylene terephthalate-based homopolymer. A polyethylene terephthalate-based polyester or a polybutylene terephthalate-based polyester having such a melting point that it does not melt at a heat treatment temperature for fusing a sheath component of a sheath-core-type heat-fusible fiber forming the weft yarn as described later is preferably a main component that forms the yarns. In addition, another fiber may be blended, spun, or paralleled with the above polyester fiber, as required.

The warp yarn is preferably a multifilament yarn, and more preferably a multifilament yarn composed of 20 to 60 filaments and having a total decitex of 100 to 300 decitex, and further preferably a multifilament yarn composed of 24 to 48 filaments and having a total decitex of 150 to 280 decitex.

The warp yarn is preferably a yarn that undergoes thermal shrinkage under such a condition that allows the heat-fusible fiber of the weft yarn to fuse in terms of the fixing effect of the engaging element, and the dry thermal shrinkage at 180° C. is preferably 4 to 20%. The melting point is preferably 140 to 330° C. in terms of controlling the fused state of the heat fusion fiber in the weft yarn and in terms of controlling the pushing state of the warp yarn. Warp yarns having various dry thermal shrinkages are available from polyester fiber manufacturers, and a yarn having an appropriate dry thermal shrinkage may be selected therefrom and be used. A yarn having a desired dry thermal shrinkage can be obtained by subjecting a commercially available polyester multifilament yarn to an appropriate heat treatment.

The weft yarn is preferably a multifilament yarn, and more preferably a multifilament yarn of a heat-fusible fiber. The weft yarn is more preferably a multifilament yarn composed of 10 to 72 filaments having a total decitex of 80 to 300 decitex, and further preferably a multifilament yarn composed of 18 to 56 filaments having a total decitex of 90 to 260 decitex. The dry thermal shrinkage at 180° C. of the weft yarn is preferably 10 to 30%.

The weft yarn is to contain a heat-fusible fiber. A typical example of the heat-fusible fiber is a sheath-core-type heat-fusible fiber having a heat fusion component as a sheath component. Since the weft yarn contains a heat-fusible fiber, the yarn for engaging elements can be strongly fixed to the woven base fabric, and it is not necessary to apply a polyurethane-based or acrylic back coating adhesive onto the rear surface of the woven-fabric hook-and-loop fastener base fabric for preventing pulling the yarn for engaging elements out of the woven base fabric, unlike in a conventional woven-fabric hook-and-loop fastener.

It is also possible to fix the yarn for engaging elements onto the base fabric by using a heat-fusible fiber in the warp yarn instead of in the weft yarn. However, since the yarn for engaging elements is threaded into the base fabric in parallel to a warp yarn, the number of points where the warp yarn intersects the yarn for engaging elements is much smaller than the number of points where the weft yarn intersects the yarn for engaging elements. Accordingly, when a heat-fusible fiber is used only in the warp yarn, the yarn for engaging elements is hardly strongly fixed to the base fabric. When the warp yarn contains a heat-fusible fiber, it is difficult to constantly keep the tension exerted on the running base fabric, and thus it tends to be difficult to continuously produce woven-fabric hook-and-loop fasteners of a constant quality in a stable manner.

The sheath-core-type heat-fusible fiber described above is preferably a fiber of a polyester-type resin in which a sheath component can be molten to thus strongly fix, onto the base fabric, the roots of the monofilament yarn for hook-shaped engaging elements or multifilament yarn for loop-shaped engaging elements which are in contact with the heat-fusible fiber or are positioned in the vicinity thereof. An example thereof is a polyester fiber that has a sheath-core-type cross section in which the core component does not melt but the sheath component melts under the heat treatment condition.

Specifically, a typical example thereof is a sheath-core-type polyester fiber in which a core component is polyethylene terephthalate and a sheath component is a copolymerized polyethylene terephthalate obtained by copolymerizing with a copolymerization component, such as isophthalic acid or adipic acid, in a large amount, for example, 20 to 30% by mole to thereby largely decrease the melting point or the softening point, or a polybutylene terephthalate in which isophthalic acid, sodium sulfoisophthalate, ethylene glycol, propylene glycol, or the like is copolymerized in an amount of 15 to 30% by mole.

The melting point or softening point of the sheath component is 120 to 210° C., and is preferably 20 to 120° C. lower than the melting point of the warp yarn, the core component, the monofilament yarn for hook-shaped engaging elements, or the multifilament yarn for loop-shaped engaging elements.

The cross-sectional shape of the sheath-core-type heat-fusible fiber may be a concentric sheath-core, an eccentric sheath-core, or an eccentric sheath-core that seemingly has a bimetallic bonded shape. Furthermore, the sheath-core-type heat-fusible fiber may be a monocore sheath-core or may be a multicore sheath-core, and in particular, is preferably a multifilament yarn composed of filaments having a monocore sheath-core cross-sectional shape, more preferably such a multifilament yarn composed of 10 to 72 filaments and having a total decitex of 80 to 300 decitex, and further preferably such a multifilament yarn composed of 18 to 56 filaments and having a total decitex of 90 to 260 decitex. The weft yarn preferably has a dry thermal shrinkage at 180° C. of 10 to 30%.

In particular, it is preferred that the weft yarn is substantially entirely formed of a sheath-core-type heat-fusible fiber, that is, the weft yarn is a multifilament yarn constituted of a sheath-core-type heat-fusible filament since both the yarn for hook-shaped engaging elements and the yarn for loop-shaped engaging elements are then strongly fixed to the base fabric.

When the fiber constituting the weft yarn is not a composite fiber or blended fiber having a sheath-core cross-sectional shape but the entire fiber cross section is formed of a heat-fusible polymer alone, a heat-fusible polymer that has been solidified again after being molten is brittle and easily breaks, and therefore, the base fabric, for example, when sewn, easily begins to rupture at a sewing thread portion. Thus, the heat-fusible fiber preferably contains a resin that is not thermally fused, and particularly preferably has a sheath-core cross-sectional shape. The ratio of the core component and the sheath component by mass is in the range of 85:15 to 40:60, and particularly preferably in the range of 80:20 to 60:40.

Furthermore, for strongly fixing both the yarn for hook-shaped engaging elements and the yarn for loop-shaped engaging elements to the base fabric, it is preferred that while thermally fusing the heat-fusible fiber, the heat-fusible fiber is thermally shrunk to compress the roots of the hook-shaped engaging elements and the loop-shaped engaging elements from opposite sides. Thus, the heat-fusible fiber preferably largely undergoes thermal shrinkage under a heat treatment condition, and preferably has a dry thermal shrinkage at 180° C. of 8 to 30%, and more preferably 10 to 25%.

The hook-shaped engaging elements constituting the hook woven-fabric hook-and-loop fastener or hook/loop coexisting woven-fabric hook-and-loop fastener are required to have such a stiffness that the hook shape is not elongated with a small force and such a so-called hook shape retention that, even if the hook shape has been elongated, the shape is immediately returned to the original hook shape once the force is removed, and thus, a monofilament yarn made of a thick, stiff synthetic fiber is used. In the present invention, as the monofilament yarn, a monofilament yarn of a polyethylene terephthalate-based polyester or polybutylene terephthalate-based polyester which is excellent in the stiffness and the hook shape retention and which does not melt at a temperature in the heat fusion of the heat-fusible fiber is used. In particular, a monofilament yarn of a polyethylene terephthalate homopolymer or a polybutylene terephthalate homopolymer is preferred.

The monofilament yarn for hook-shaped engaging elements preferably has a diameter of 0.12 to 0.23 mm in terms of the hook shape retention and the stiffness as described above, and more preferably 0.14 to 0.21 mm. For increasing the engaging force, the cross-sectional shape of the monofilament may be a modified cross-sectional shape, such as a triangle, quadrangle, or other polygonal shape. Such a monofilament yarn for hook-shaped engaging elements is preferably thermally shrunk under a condition where a heat-fusible fiber is fused as with the case of the warp yarn in terms of the fixing effect of the engaging elements, and preferably has a dry thermal shrinkage at 180° C. of 10 to 25%.

The yarn for loop-shaped engaging elements constituting the loop woven-fabric hook-and-loop fastener or hook/loop coexisting woven-fabric hook-and-loop fastener preferably has both the cutting resistance to a pulling force in peeling the engagement with hook-shaped engaging elements and the so-called loop shape retention for, even if a wide loop shape is elongated by engagement, immediately returning to the original wide loop shape once a force is removed. Thus, as with the case of the yarn for hook-shaped engaging elements, the yarn for loop-shaped engaging elements is preferably a multifilament yarn of a polyethylene terephthalate-based polyester or a polybutylene terephthalate-based polyester that has a melting point of 195 to 270° C. so as not to melt at a temperature in heat fusion of the heat-fusible fiber, and more preferably a multifilament yarn of a polyethylene terephthalate homopolymer or a polybutylene terephthalate homopolymer.

The yarn for loop-shaped engaging elements is preferably a multifilament yarn composed of 5 to 15 filaments and having a total decitex of 150 to 500 decitex in terms of the loop shape retention and the cutting resistance, and more preferably a multifilament yarn composed of 6 to 12 filaments and having a total decitex of 200 to 400 decitex. Since the initial engagement strength and the texture are more improved, a multifilament yarn composed of 40 to 180 filaments and having a total decitex of 200 to 600 decitex is also preferably used. Such a multifilament yarn for loop-shaped engaging elements preferably undergoes thermal shrinkage under a condition where the heat-fusible fiber is fused, as with the case of the warp yarn, in terms of the fixing effect of the loop-shaped engaging elements, and preferably has a dry thermal shrinkage at 180° C. of 10 to 25%.

In the step 1, a woven fabric for hook-and-loop fastener is first woven with the warp yarn, the weft yarn, the monofilament yarn for hook-shaped engaging elements, the multifilament yarn for loop-shaped engaging elements described above. The woven structure is preferably a plain weave obtained by using a monofilament yarn for hook-shaped engaging elements and a multifilament yarn for loop-shaped engaging elements as a part of the warp yarn. The yarns for engaging elements are woven in parallel to the warp yarn.

In the case of a hook woven-fabric hook-and-loop fastener, it is preferred to weave a yarn so that the yarn rises up from the woven base fabric front surface on the way, runs over one to three threads of the warp yarn while forming a loop, and crawls in between threads of the warp yarn since one leg of each loop for hook engaging element is then easily cut in an efficient manner.

On the other hand, in the case of a loop woven-fabric hook-and-loop fastener, it is preferred to weave a yarn so that the yarn forms the loop without running over the warp yarn and is present in parallel to the warp yarn since the loop-shaped engaging element then tends to be oriented toward such a direction that the loop-shaped engaging element easily engages with a hook-shaped engaging element.

Furthermore, in the case of the hook/loop coexisting woven-fabric hook-and-loop fastener, it is preferred to weave a yarn for hook-shaped engaging elements so that the yarn runs over one to three threads of the warp yarn while forming a loop and crawls in between threads of the warp yarn, and to weave a yarn for loop-shaped engaging elements so that the yarn runs over one thread of the warp yarn while forming a loop and crawls in between threads of the warp yarn since a side of one leg of each loop for hook-shaped engaging element can then be efficiently cut and furthermore, the hook-shaped engaging element and the loop-shaped engaging element are then be easily engaged.

The warp yarn preferably has a weave density after the heat treatment of 35 to 80/cm and the weft yarn preferably has a weave density after the heat treatment of 12 to 30/cm since the roots of the engaging elements can then be strongly fixed to the base fabric. The ratio by weight of the weft yarn to the total weight of the yarn for hook-shaped engaging elements or yarn for loop-shaped engaging elements, the warp yarn, and the weft yarn which constitute the woven-fabric hook-and-loop fastener is preferably 15 to 40% for the same reason as above.

The thread counts of the monofilament yarn for hook-shaped engaging elements and the multifilament yarn for loop-shaped engaging elements is each preferably about 2 to 8 based on 20 threads of the warp yarn (including the monofilament yarn for hook-shaped engaging elements or multifilament yarn for loop-shaped engaging elements) in terms of the engaging force. In the case of a hook/loop coexisting woven-fabric hook-and-loop fastener, the total thread count of the monofilament yarn for hook-shaped engaging elements and the multifilament yarn for loop-shaped engaging elements is preferably 2 to 8 based on 20 threads of the warp yarn (including the monofilament yarn for hook-shaped engaging elements and multifilament yarn for loop-shaped engaging elements) for the same reason. The ratio of the thread count of the monofilament yarn for hook-shaped engaging elements and that of the multifilament yarn for loop-shaped engaging elements is preferably 40:60 to 60:40 for the same reason.

In an aspect of the present invention, as shown in FIG. 1, a woven fabric for hook-and-loop fastener in which a selvage area (2*a*) having no loops for engaging element and extending in parallel to the warp direction (Wa) is formed on each of two opposite ends of an engaging element area (1) having loops for engaging element is produced by weaving. In the present invention, misalignment in the weft direction of the selvage area is corrected.

In another aspect of the present invention, as shown in FIG. 2, one or two or more areas for forming selvage (2*b*) having no loops for engaging element are provided in parallel to the warp direction (Wa) between two selvage areas (2*a*). An area having engaging elements is divided into two or more parts by the areas for forming selvage (2*b*). By slitting an intermediate portion of the area for forming selvage (2*b*) accurately in the warp direction, two or more woven-fabric hook-and-loop fasteners each having a selvage with an even width on each of two opposite ends can be obtained simultaneously in a productive manner, and thus the effect of the present invention is furthermore exhibited.

In other words, it is preferred that two selvage areas (2*a*) and one or two or more areas for forming selvage (2*b*) are present at intervals in the weft direction (We) on the base fabric front surface (in FIG. 2, two selvage areas and three areas for forming selvage are present) so that the engaging element area (1) is continuous in the warp direction (Wa) but is divided by the areas for forming selvage (2*b*) into two or more areas (in FIG. 2, four engaging element areas) in the weft direction (We).

The width of the weft direction (We) of the selvage area (2*a*) (after thermal shrinkage) is preferably 0.5 to 10.0 mm, more preferably 1 to 8 mm, and the width in the weft direction (We) of the area for forming selvage (2*b*) (after thermal shrinkage) is preferably 1 to 8 mm, and more preferably 2 to 6 mm. The engaging element area (1) is preferably divided by the areas for forming selvage (2*b*) in the weft direction (We) into two or more areas having a width of 7 to 50 mm. The engaging element area (1) is particularly preferably divided into two or more areas having a width of 15 to 30 mm.

The total width in the weft direction (We) of the woven fabric before slitting the area for forming selvage (2*b*) is preferably in the range of 80 to 300 mm in terms of the productivity. Accordingly, the engaging element area (1) is preferably divided by the area(s) for forming selvage (2*b*) into 2 to 12 areas. A yarn for engaging elements is preferably not woven into the area for forming selvage (2*b*) in terms of the softness of the woven-fabric hook-and-loop fastener.

In the step 2, as shown in FIG. 5, a woven fabric for hook-and-loop fastener (6) which is thus obtained is subjected to a heat treatment preferably in the state of the long size without winding on the way by allowing the woven fabric to continuously run through a heat treatment furnace (7). By the heat treatment, while melting only the sheath component of the sheath-core-type heat-fusible fiber constituting the weft yarn, the warp yarn, the yarn for engaging elements, and the weft yarn are thermally shrunk to strongly fix the yarn for engaging elements to the woven base fabric. In the long woven fabric for hook-and-loop fastener (6) running through the heat treatment furnace, no excess tension is exerted so that the yarns can be sufficiently shrunk, and the long hook-and-loop fastener woven fabric is preferably allowed to run in the heat treatment furnace in a free state without the upper and lower faces thereof touching something.

Since the yarn for engaging elements is fixed to the woven base fabric by the heat treatment, an application of a back coating adhesive liquid and a drying treatment which have been performed for a conventional woven-fabric hook-and-loop fastener are not required, and the problem in the process and the problem in the performance in that the softness, air permeability, and liquid permeability of a woven-fabric hook-and-loop fastener are impaired which are caused by the use of a back coating adhesive can be prevented. Furthermore, in the case of a hook woven-fabric hook-and-loop fastener or a hook/loop coexisting woven-fabric hook-and-loop fastener, the shape of loops for hook-shaped engaging element is fixed by heat in the heat treatment, and thus the hook shape is kept even after cutting one leg of each of loops for hook-shaped engaging element to form hook-shaped engaging elements later, resulting in a sufficient engaging strength. Also in the case of loop-shaped engaging elements, the loops having an even shape with a natural spread are obtained.

The heat treatment temperature used is generally 150 to 250° C. which is such a temperature that the heat-fusible fiber constituting the weft yarn melts or softens but the other yarns do not melt and that the monofilament yarn for hook-shaped engaging elements is fixed in a loop shape and the multifilament yarn for loop-shaped engaging elements is fixed in a loop shape having a natural spread, and is preferably in the range of 175 to 230° C., and further preferably in the range of 190 to 220° C. Such a heat treatment is generally, as shown in FIG. 5, performed by allowing the woven fabric for hook-and-loop fastener to run through the heat treatment furnace (7) without touching any substance, such as a roller or guide, that is, in the no-contact state. If the woven fabric touches a roller, guide, or the like in the heat treatment furnace (7), the thermal shrinkage is suppressed due to the touching in the way to generate a partial strain, which is not preferred. Preferably, the woven fabric for hook-and-loop fastener (6) is allowed to run at a rate of 0.30 to 1.30 m/minute so as to stay for 20 to 120 seconds in the heat treatment furnace, whereby the heat treatment is completed. In FIG. 5, L represents a loop for engaging element.

In the step 3, immediately after the thus heat-treated woven fabric for hook-and-loop fastener comes out of the heat treatment furnace (7), as shown in FIG. 5, an operation to push the rear surface of the woven base fabric against a fixed surface or rolling surface (8) in the state where the heat-fusible fiber remains molten is performed. In FIG. 5, an operation to push the rear surface of the woven fabric for hook-and-loop fastener against the fixed surface (8) is performed immediately after coming out of the heat treatment furnace (7). For pushing only the rear surface against the fixed surface or rolling surface (8), it is needed to bring the rear surface into contact with the fixed surface or rolling surface (8) in the state where a tension is exerted to the woven base fabric. This is considered to be a cause of correcting a topical strain or correcting misalignment of the warp yarn.

By performing the above operation, a topical uneven strain of the woven fabric for hook-and-loop fastener due to thermal shrinkage occurring in the heat treatment furnace (7) is corrected, and misalignment in the weft direction of the selvage area and misalignment in the weft direction of the area for forming selvage are corrected. As a result, a long woven-fabric hook-and-loop fastener in which a selvage area with a constant width is present on each of two opposite ends continuously in the warp direction in a straight line is obtained. In addition, an intermediate portion of the area for forming selvage can be accurately slitted in the warp direction, and thus, two or more woven-fabric hook-and-loop fasteners having a selvage area having an even width on each of two opposite ends can be simultaneously obtained in an efficient manner.

It is preferred that the front surface and the rear surface of the woven fabric for hook-and-loop fastener never come in contact with a solid substance, such as a roller or a guide, during from entering the heat treatment furnace to pushing of the rear surface against a fixed surface or a rolling surface, and the rear surface comes in contact with a fixed surface or a rolling surface for the first time immediately after coming out of the heat treatment furnace.

In the present invention, the fixed surface or rolling surface against which the woven base fabric rear surface is pushed in the state where the heat-fusible fiber remains molten is preferably set so that the contact length with the woven base fabric rear surface is 20 to 100 mm and the contact time is 2 to 10 seconds. Examples of suitable materials of the fixed surface or rolling surface include a metal, a ceramic, or a heat resistant resin. The front surface of the fixed surface or rolling surface may be in a mirror surface state or a pear skin-like state, or may have a little unevenness as long as the base fabric rear surface can be pushed against it.

When a fixed surface is used, as shown in FIG. 5, the fixed surface preferably has such a shape that the woven base fabric rear surface changes the running direction along the fixed surface (8) since the effect is then particularly easily achieved. In FIG. 5, the woven fabric for hook-and-loop fastener (6) changes the running direction 90° along the fixed surface (8). Note that the fixed surface or rolling surface is preferably heated to a temperature 80 to 210° C. lower than the heat treatment temperature for enhancing the contact effect, but in general, the temperature may be adjusted so that the front surface of the fixed surface or rolling surface (8) is in a heated state by a remaining heat in the heat-treated woven fabric for hook-and-loop fastener (6) coming out of the heat treatment furnace. The surface against which the woven base fabric rear surface is pushed may be any of a fixed surface, a rolling surface such that the contact surface rolls according to running of the woven fabric for hook-and-loop fastener, and a driven rolling surface that aggressively pulls the woven fabric for hook-and-loop fastener. The surface may be a narrow surface in a guide shape.

In the present invention, as shown in FIG. 5, it is preferred that the woven fabric for hook-and-loop fastener (6) passes through the heat treatment furnace (7), the warp yarn and the weft yarn are shrunk during passing through heat the treatment furnace (7) as described above, and immediately after coming out of the heat treatment furnace (7), the woven fabric for hook-and-loop fastener (6) continues to run on the fixed surface or rolling surface (8). Accordingly, when being pushed against the fixed surface or rolling surface (8), the woven fabric for hook-and-loop fastener (6) is under a tension in the warp direction.

The tension exerted on the woven fabric for hook-and-loop fastener immediately after the woven fabric for hook-and-loop fastener passes through the fixed surface or rolling surface (8) is preferably about 50 to 600 g/cm. Accordingly, it is preferred that a tension is exerted on the woven fabric for hook-and-loop fastener as less as possible before passing through the fixed surface or rolling surface (8), and that such a tension as described above is exerted on the woven fabric for hook-and-loop fastener immediately after passing through the fixed surface or rolling surface (8).

In the case of the woven-fabric hook-and-loop fastener of the present invention, the warp yarn alternately runs over and under the weft yarn with the weft yarn interposed therebetween, and thus, the woven base fabric rear surface is in the state covered by the warp yarn. Accordingly, the weft yarn containing a heat-fusible fiber is hardly in direct contact with the fixed surface or rolling surface. Thus, the molten heat-fusible fiber does not directly attach to the front surface of the fixed surface or rolling surface, and thus, a trouble caused by such attachment does not occur.

In particular, when a woven-fabric hook-and-loop fastener having hook-shaped engaging elements is produced, by pushing the rear surface of the woven fabric for hook-and-loop fastener (6) against the fixed surface or rolling surface (8) in the state where the heat-fusible fiber remains molten, misalignment in the weft direction of the warp yarn and the yarn for engaging elements is corrected. Furthermore, in an operation to cut one leg of each loop for hook-shaped engaging element to produce a hook-shaped engaging element to be performed thereafter, only one leg can be accurately cut, and thus, a hook woven-fabric hook-and-loop fastener or hook/loop coexisting woven-fabric hook-and-loop fastener having hook-shaped engaging elements each with only one leg accurately and securely cut can be obtained.

An operation to push the rear surface of the woven fabric for hook-and-loop fastener (6) against the fixed surface or rolling surface (8) in the state where the heat-fusible fiber used in the weft yarn remains molten, as shown in FIG. 5, is preferably performed continuously to the heat treatment in the heat treatment furnace (7) using a remaining heat in the heat treatment without cooling the woven fabric for hook-and-loop fastener after the heat treatment in terms of the productivity. Alternatively, the woven fabric for hook-and-loop fastener coming out of the heat treatment furnace (7) may be once cooled and then, be heated again to make the heat-fusible fiber into a molten state, and in the molten state, an operation to push the woven fabric for hook-and-loop fastener against the fixed surface or rolling surface (8) may be performed.

By performing an operation to push the rear surface of the woven fabric for hook-and-loop fastener (6) against the fixed surface or rolling surface (8) in the state where the heat-fusible fiber remains molten, as shown in FIG. 3, a thickness Tb of the warp yarn, which alternately runs over and under the weft yarn with the weft yarn interposed therebetween, in a base fabric thickness direction (K) at a point where the warp yarn is the most subducted toward the rear surface side is 0.94 times or less a thickness Ts thereof in the base fabric thickness direction at a point where the warp yarn is the most floated toward the front surface side. Tb is preferably 0.92 times Ts or less, and Tb is more preferably 0.88 times Ts or less.

However, when Tb is too small as compared with Ts, the rear surface of the woven base fabric becomes dense and plane by the heat fusion, and the softness, texture, air permeability, and liquid permeability which are advantages of the woven fabric are impaired, which is not preferred. Accordingly, Tb is preferably 0.7 times Ts or more, and more preferably 0.75 times Ts or more.

FIG. 3 schematically shows a cross section of the woven-fabric hook-and-loop fastener that exhibits an effect of the present invention achieved by performing an operation to push the rear surface of the woven fabric for hook-and-loop fastener (6) against the fixed surface or rolling surface (8) in the state where the heat-fusible fiber remains molten.

On the other hand, FIG. 4 schematically shows a cross section of the woven-fabric hook-and-loop fastener in the case where an operation to push the rear surface of the woven fabric for hook-and-loop fastener (6) against the fixed surface or rolling surface (8) in the state where the heat-fusible fiber remains molten is not performed. In this case, the Tb value is almost the same as the Ts value, and the Tb/Ts ratio defined in the present invention is not satisfied.

Note that, even when an operation to push the rear surface of the woven base fabric against a fixed surface or a rolling surface in the state where the heat-fusible fiber remains molten is not performed, the Tb value is sometimes reduced than the Ts value in the production process due to the self-weight of the hook-and-loop fastener woven fabric, but such a reduction is extremely minute and Tb does not become 0.96 times Ts or less. The effect of the present invention in that misalignment or the like in the weft direction of the warp yarn and the yarn for engaging elements is corrected is achieved only by Tb being 0.94 times Ts or less.

Next, a method of measuring Tb and Ts of the warp yarn which alternately runs over and under the weft yarn with the weft yarn interposed therebetween will be described.

First, an area that had engaging elements on the front surface of the woven-fabric hook-and-loop fastener and that had a small influence of the engaging elements was cut with a safety razor blade for shaving between threads of the warp yarn in parallel to the warp yarn. A photograph of a cross section of the obtained cut area was taken at a magnification of ×200. The obtained cross-sectional photograph of the cut area is schematically shown in FIG. 3. In the photograph, arbitrary three points where the warp yarn was the most subducted toward the rear surface side were selected in order, and arbitrary three points where the warp yarn was the most floated toward the front surface side were selected in order. The thickness of each point in the base fabric thickness direction was measured. The same measurement was performed at arbitrary ten points on the woven-fabric hook-and-loop fastener. The highest five measurement values were removed from the 30 measurement values in total of the thickness in the base fabric thickness direction at a point where the warp yarn is the most subducted toward the rear surface side and the lowest five measurement values were removed from the 30 measurement values in total of the thickness in the base fabric thickness direction at a point where the warp yarn is the most floated toward the front surface side, and the average of the remaining 20 measurement values was determined for each. The obtained respective averages are the warp yarn thickness Tb in the base fabric thickness direction at a point where the warp yarn was the most subducted toward the rear surface side and the warp yarn thickness Ts in the base fabric thickness direction at a point where the warp yarn was the most floated toward the front surface side.

Note that even when the woven-fabric hook-and-loop fastener woven fabric is pushed against a fixed surface or a rolling surface in the state where the heat-fusible resin remains molten, all the points where the warp yarn is the most subducted toward the rear surface of the warp yarn which is present on the rear surface of the hook-and-loop fastener woven fabric are not pushed against a fixed surface or a rolling surface, and thus, among them, there may be a point where the warp yarn is not pushed against a fixed surface or a rolling surface so that Tb and Ts are almost the same. In the present invention, such a point is included in the arbitrarily selected points, and thus, the Tb/Ts ratio defined in the present invention is an average including such a point.

FIG. 4 is a view in the case where a hook-and-loop fastener woven fabric is not pushed against a fixed surface or a rolling surface as described above. As shown in FIG. 4, when the Tb value is almost the same as the Ts value, misalignment in the weft direction of the warp yarn and the yarn for engaging elements generated by shrinkage in the heat treatment is not corrected, and thus, it is difficult to accurately slit an intermediate portion of the area for forming selvage, and thus, it is also difficult to obtain a hook woven-fabric hook-and-loop fastener or a hook/loop coexisting woven-fabric hook-and-loop fastener having hook-shaped engaging elements each with only one leg accurately and securely cut.

In the present invention, the Tb/Ts ratio depends mainly on the strength when the woven base fabric is pushed against a fixed surface or a rolling surface. Accordingly, by allowing the woven base fabric to run on a fixed surface or rolling surface with a tension exerted, and changing the running direction along the fixed surface or rolling surface as shown in FIG. 5, the Tb/Ts ratio can be freely varied.

In the present invention, in pushing the rear surface of the woven base fabric against a fixed surface or a rolling surface in the state where the heat-fusible fiber remains molten, it is preferred that the front surface side of the woven base fabric having loops for engaging element is not pushed against a fixed surface or a rolling surface. For example, when the woven fabric for hook-and-loop fastener is interposed between rolls and an operation to press the woven fabric for hook-and-loop fastener from above and below is performed, loops for engaging element which uprightly stand on the front surface of the woven base fabric are pushed down, and are fixed on the front surface of the woven base fabric in this state. Accordingly, the engaging ability of the woven-fabric hook-and-loop fastener decreases and the appearance of the woven-fabric hook-and-loop fastener also deteriorates. In addition, when both the front surface side and the rear surface side of the woven fabric for hook-and-loop fastener are pushed against a fixed surface or a rolling surface, Tb becomes almost the same as Ts, and the Tb/Ts ratio defined in the present invention cannot be satisfied.

When a hook woven-fabric hook-and-loop fastener or a hook/loop coexisting woven-fabric hook-and-loop fastener is produced, as described above, the woven fabric for hook-and-loop fastener, which is obtained by pushing the rear surface of a woven base fabric against a fixed surface or a rolling surface while the heat-fusible fiber remains molten after a heat treatment, is cooled, and then, one leg of each of loops for hook-shaped engaging element protruding from the front surface thereof is cut to form hook-shaped engaging elements (step 4).

As a cutting apparatus used for cutting one leg of each loop for hook-shaped engaging element, a cutting apparatus having a structure in which one leg of each loop for hook-shaped engaging element is cut by a reciprocating motion of a mobile cutting blade disposed between two fixed blades is preferred. When a loop for hook-shaped engaging element is formed at a position over a warp yarn, only one leg of the loop can be accurately and securely cut using the cutting apparatus, which is preferred.

In the present invention, when a loop woven-fabric hook-and-loop fastener is produced, by continuously running the weaving step (step 1), the heat treatment step (step 2), and the step of pushing the rear surface against a fixed surface or a rolling surface (step 3) without winding into a roll on the way, a loop woven-fabric hook-and-loop fastener can be produced in a productive manner. In addition, when a hook woven-fabric hook-and-loop fastener or a hook/loop coexisting woven-fabric hook-and-loop fastener is produced, the weaving step (step 1), the heat treatment step (step 2), the step of pushing the rear surface against a fixed surface or a rolling surface (step 3), and furthermore, the step of cutting one leg of each of loops for hook-shaped engaging element to form hook-shaped engaging elements (step 4) can be performed at the same rate, a woven-fabric hook-and-loop fastener can be produced in a productive manner by continuously running the steps without winding on the way.

On the other hand, when a conventional woven-fabric hook-and-loop fastener with a back coating adhesive applied on the rear surface is produced, a step of weaving a woven fabric for hook-and-loop fastener can be performed quickly, but it takes a time to apply an adhesive liquid on the rear surface of a woven base fabric and to evaporate the solvent of the additive and dry the base fabric, and thus, the steps cannot be performed at the same rate. As a result, it is required to once wind a woven fabric for hook-and-loop fastener after weaving and then unwind the wound woven fabric for hook-and-loop fastener before the next back coating adhesive application and drying step, which has been extremely inferior in the productivity. The present invention is also superior in this point.

Since a polyester-type yarn forming the woven-fabric hook-and-loop fastener of the present invention is stiffer than a nylon-type yarn and a polyolefin-type yarn generally used in a conventional woven-fabric hook-and-loop fastener, it has been considered that the obtained woven-fabric hook-and-loop fastener is also stiff and is not suitable for the everyday sundries field, such as clothing, shoes, and globes, where the softness is demanded. However, in the present invention, a back coating adhesive is not to be applied, and thus the stiffness of the woven-fabric hook-and-loop fastener due to the back coating adhesive application is inhibited. Thus, the woven-fabric hook-and-loop fastener of the present invention, although being made of a polyester-type yarn, has an enough softness to be used in the garments or everyday sundries field where softness is demanded.

Moreover, in the case of a conventional woven-fabric hook-and-loop fastener in which a back coating adhesive is applied on the rear surface, a back coating adhesive layer on the rear surface reduces the liquid permeability of the woven-fabric hook-and-loop fastener, and thus the dyeing liquid cannot pass through the woven-fabric hook-and-loop fastener, leading to poor dye-affinity. For avoiding this, the fastener is to be dyed before application of a back coating adhesive, that is, in the state where yarns constituting the woven-fabric hook-and-loop fastener are not fixed to the base fabric. In the case of dyeing in the state not fixed to the base fabric, yarns constituting the woven-fabric hook-and-loop fastener move due to flowing of the dyeing liquid during the dyeing treatment, and as a result, there arises a problem in that the alignment of the engaging elements is disordered. In the present invention, since the yarns constituting the woven-fabric hook-and-loop fastener are fixed to a woven base fabric by a heat treatment and further, the woven-fabric hook-and-loop fastener has liquid permeability even after the heat treatment, the fastener can be dyed after the heat treatment, causing no problem unlike the related art.

In the present invention, the obtained long polyester woven-fabric hook-and-loop fastener is preferably wound for the first time, immediately after completion of the step 4 of cutting one leg of each of loops for hook-shaped engaging element to form hook-shaped engaging elements in the case with the step 4, or immediately after completion of the step 3 of pushing the rear surface against a fixed surface or a rolling surface in the case without the step 4. Dyeing with a dyeing liquid containing a disperse dye in this wound state is preferred, in terms of the productivity since the hook-and-loop fastener can be dyed at once without misalignment in the weft direction of the yarn for engaging elements due to a dyeing treatment and in the wide state without any strain, and furthermore in terms of achieving a uniform dyeing. When the step 5 is performed, the step is preferably performed after dyeing.

The dyeing treatment is preferably performed as follows.

The wound wide woven fabric for hook-and-loop fastener before slitting is placed in a liquid-permeable cylindrical container that has a height slightly higher than the width of the woven fabric for hook-and-loop fastener, and the containers are stacked in a dyeing pot. In this state, a dye liquid containing a disperse dye is put in the dyeing pot and the dye liquid is circulated through the woven fabric for hook-and-loop fastener at a temperature of 110 to 145° C. and at a pressure of 2 to 5 MPa from above, below, the side surface of, and the central portion of the container to dye the woven fabric. By the dyeing treatment, a wide woven-fabric hook-and-loop fastener before slitting dyed without uneven dyeing can be obtained at once in an efficient manner. Of course, when the dyeing treatment is not required, the dyeing treatment does not have to be applied.

When the thus-obtained woven-fabric hook-and-loop fastener has the area for forming selvage, the area for forming selvage is slitted at the center in the width direction in the warp direction. Accordingly, two or more long woven-fabric hook-and-loop fasteners are simultaneously produced. In particular, in the woven-fabric hook-and-loop fastener of the present invention, since misalignment in the weft direction is hardly present in the selvage area and the area for forming selvage even after dyeing, it is easy to accurately slit the area for forming selvage at the center in the width direction along the warp direction, and a woven-fabric hook-and-loop fastener having selvages having an even width can be easily obtained. Note that when a post treatment, such as a flame-proofing treatment or a water-repellent treatment, is applied on the woven-fabric hook-and-loop fastener, the treatment is preferably applied prior to slitting in terms of the productivity.

Whether the woven-fabric hook-and-loop fastener is dyed before slitting can be easily determined by checking the dyeing state of the slitted surface. When the woven-fabric hook-and-loop fastener was dyed before slitting, a fiber cross section of the slitted portion has a dyeing concentration the same as that of a fiber cross section of another portion, but when dyed after slitting, a fiber cross section of the slitted portion has a dyeing concentration higher than that of another portion.

In the woven-fabric hook-and-loop fastener of the present invention, the hook-shaped engaging elements preferably have a height from the woven base fabric front surface of 1.2 to 2.1 mm and the loop-shaped engaging elements have a height from the woven base fabric front surface of 1.9 to 3.0 mm in terms of the engaging force and the resistance to the falling down of the engaging elements.

The density of the hook-shaped engaging elements in the hook woven-fabric hook-and-loop fastener, the density of the loop-shaped engaging elements in the loop woven-fabric hook-and-loop fastener, and the total density of the hook-shaped engaging elements and loop-shaped engaging elements in the hook/loop coexisting woven-fabric hook-and-loop fastener based on the area of the woven base fabric portion having engaging elements after thermal shrinkage are preferably 30 to 70/cm$^2$, 35 to 140/cm$^2$, and 35 to 70/cm$^2$, respectively. The hook/loop coexisting woven-fabric hook-and-loop fastener preferably has a ratio of the number of hook-shaped engaging elements and the number of loop-shaped engaging elements in the range of 40:60 to 60:40.

The hook woven-fabric hook-and-loop fastener, loop woven-fabric hook-and-loop fastener, and hook/loop coexisting woven-fabric hook-and-loop fastener of the present invention can be used in the application field in which conventional general woven-fabric hook-and-loop fasteners are used. They can be used in a wide range of fields, such as shoes, bags, hats, globes, garments, sphygmomanometers, supporters, binding bands for packing, binding tapes, various toys, fixation of engineering sheets, fixation of various panels and wall materials, fixation of electrical parts, assembly/disassembly storage boxes and packing cases, small articles, and curtains. In particular, they are suitable for the application fields in which a woven-fabric hook-and-loop fastener is attached to a fabric or sheet by sewing, for example, fields, such as garments, shoes, bags, hats, globes, and supporters.

EXAMPLES

The present invention will be described more specifically below. In the examples, the engaging force of a woven-fabric hook-and-loop fastener was measured according to JIS L 3416. When a woven-fabric hook-and-loop fastener of Examples and Comparative Examples was a loop woven-fabric hook-and-loop fastener, a hook woven-fabric hook-and-loop fastener A8693Y (manufactured by KURARAY FASTENING) was used as a counterpart of the engagement. When a woven-fabric hook-and-loop fastener of Example and Comparative Example was a hook woven-fabric hook-and-loop fastener, a loop woven-fabric hook-and-loop fastener B2790Y (manufactured by KURARAY FASTENING) was used as a counterpart of the engagement. When a woven-fabric hook-and-loop fastener of Example and Comparative Example was a hook/loop coexisting woven-fabric hook-and-loop fastener, the same hook/loop coexisting woven-fabric hook-and-loop fastener was used.

Example 1: Loop Woven-Fabric Hook-and-Loop Fastener

As a warp yarn, a weft yarn, and a multifilament yarn for loop-shaped engaging elements constituting a loop woven-fabric hook-and-loop fastener, the following yarns were used.

Warp Yarn

Multifilament yarn of polyethylene terephthalate having a melting point of 260° C.

Total decitex and number of filaments: 167 dtex and 30

Dry thermal shrinkage at 180° C.: 16%

Weft Yarn: Multifilament Yarn of Heat-Fusible Sheath-Core-Type Fiber

Core component: polyethylene terephthalate (melting point: 260° C.)

Sheath component: 25-mol % isophthalic acid copolymerized polyethylene terephthalate (melting point: 190° C.)

Core-sheath ratio (by weight): 70:30

Total decitex and number of filaments: 120 dtex and 24

Dry thermal shrinkage at 180° C.: 15%

Multifilament for Loop-Shaped Engaging Elements

Polybutylene terephthalate fiber (melting point: 220° C.)

Total decitex and number of filaments: 305 dtex and 8

Dry thermal shrinkage at 180° C.: 14%

Using the warp yarn, the weft yarn, and the multifilament yarn for loop-shaped engaging elements, a woven fabric for loop woven-fabric hook-and-loop fastener having a plain weave structure (sometimes referred to simply as "woven fabric for hook-and-loop fastener") was produced by weaving as follows.

The warp yarn and the weft yarn were threaded so that the weave densities after a thermal shrinkage treatment were 55/cm for the warp yarn and 21/cm for the weft yarn. The multifilament yarn for loop-shaped engaging elements was threaded at a rate of one thread per 4 threads of the warp yarn in parallel to the warp yarn so as to alternately run over and under five threads of the weft yarn without running over the warp yarn and then form a loop on the woven base fabric.

The obtained woven fabric for hook-and-loop fastener had the following areas in order from one end to the other end parallel to the warp direction.

Selvage area with a width of 7.0 mm on one end,
Engaging element area with a width of 22.5 mm,
Area for forming selvage with a width of 6.0 mm,
Engaging element area with a width of 22.5 mm,
Area for forming selvage with a width of 6.0 mm,
Engaging element area with a width of 22.5 mm,
Area for forming selvage with a width of 6.0 mm,
Engaging element area with a width of 22.5 mm,
Selvage area with a width of 7.0 mm on the other end.

The obtained woven fabric for hook-and-loop fastener having a width of 12.2 cm was subjected to a heat treatment by allowing the woven fabric to run through a heat treatment furnace for 60 seconds at 195° C., which was a temperature at which only the sheath component of the weft yarn was thermally molten and the warp yarn, the multifilament yarn for loop engaging elements, and the core components of the weft yarn were not thermally molten, without touching a solid substance and with little tension exerted, to cause shrinkage of the weft yarn, the weft yarn, and the multifilament yarn for loop-shaped engaging elements. As a result, the woven fabric for hook-and-loop fastener was shrunk 10% in the weft direction, and the sheath component was molten and fused to nearby threads.

Subsequently, in the state where the heat-fusible fiber (sheath component) remained molten, as illustrated in FIG. 5, the woven fabric for hook-and-loop fastener was allowed to run for 5 seconds while pushing the rear surface thereof against a stainless-steel fixed surface having a pearskin-like surface (contact length with the rear surface: 5 cm) placed immediately after the outlet of the heat treatment furnace, and then, was allowed to run with a tension of 200 g/cm exerted.

After cooling, the obtained loop woven-fabric hook-and-loop fastener was wound.

Note that the step 1 of weaving the woven fabric for hook-and-loop fastener, the step 2 of heat treatment, and the step 3 of pushing the rear surface against the fixed surface were continuously performed without winding on the way.

The obtained loop woven-fabric hook-and-loop fastener had a loop-shaped engaging element density of 44/cm$^2$ and a height of loop-shaped engaging elements from the woven base fabric front surface of 2.1 mm.

The obtained loop woven-fabric hook-and-loop fastener was inserted into a liquid permeable cylindrical container in the wound state. This container was placed in a dyeing pot, and the pot was filled with a dyeing liquid containing an indigo disperse dye, and the dyeing liquid was allowed to pass and circulate through the woven-fabric hook-and-loop fastener with a heat of 135° C. at a pressure of 3.5 MPa to dye the woven-fabric hook-and-loop fastener.

The area for forming selvage interposed between the engaging element areas of the obtained indigo-dyed loop woven-fabric hook-and-loop fastener was slitted at the center in the width direction in parallel to the warp yarn to obtain four 25-mm width long loop woven-fabric hook-and-loop fasteners with selvages which each had a 2-mm width selvage area on each of two opposite ends and had a 21-mm width engaging element area having loop-shaped engaging elements in a portion interposed between the selvage areas. All the obtained four long loop woven-fabric hook-and-loop fasteners had no uneven dyeing and all the four were dyed into the same concentration. Furthermore, a fiber cross section of the slitted portion has the same dyeing concentration as that of a fiber cross section of another portion.

As compared with a conventional loop woven-fabric hook-and-loop fastener formed of a nylon-type yarn with a back coating adhesive applied thereon, the obtained loop woven-fabric hook-and-loop fastener with selvages was superior in the softness and the widths of the selvage areas (including the selvage area obtained by slitting the area for forming selvage) were always a constant width of 2 mm, and there was no misalignment in the weft direction of the warp yarn. Accordingly, a problem in that the appearance of the loop woven-fabric hook-and-loop fastener worsens because a cut end of a warp yarn thread cut due to misalignment of a selvage area projects from an end of the selvage area did not occur. The warp yarn thickness Tb in the base fabric thickness direction at a point where the warp yarn is the most subducted toward the rear surface side and the warp yarn thickness Ts in the base fabric thickness direction at a point where the warp yarn is the most floated toward the front surface side were measured, and then, as shown in FIG. 3, Tb was 0.089 mm, Ts was 0.104 mm, and Tb/Ts was 0.86. The engaging force of the obtained loop woven-fabric hook-and-loop fastener was measured, and then, the loop woven-fabric hook-and-loop fastener had a shear initial strength of 14.9 N/cm$^2$, an initial peeling strength of 1.15 N/cm, a shear strength after 1000 engagement/peeling operations of 13.6 N/cm$^2$, and a peeling strength after 1000 engagement/peeling operations of 1.05 N/cm. Thus, it was found that the loop woven-fabric hook-and-loop fastener had excellent engaging force as a woven-fabric hook-and-loop fastener.

The obtained loop woven-fabric hook-and-loop fastener was attached by sewing onto a sleeve opening of a windbreaker as a hook-and-loop fastener to be used for opening and closing the sleeve opening. Then, the hook-and-loop fastener was soft, and since the selvage width was always constant, the loop woven-fabric hook-and-loop fastener could be attached with good appearance without meandering of the sewing thread.

Example 2: Hook Woven-Fabric Hook-and-Loop Fastener

As a warp yarn, a weft yarn, and a multifilament yarn for hook-shaped engaging elements constituting a hook woven-fabric hook-and-loop fastener, the following yarns were used.

Warp Yarn

Multifilament yarn of polyethylene terephthalate having a melting point of 260° C.

Total decitex and number of filaments: 167 dtex and 30

Dry thermal shrinkage at 180° C.: 16%

Weft Yarn: Multifilament Yarn of Heat-Fusible Sheath-Core-Type Fiber

Core component: polyethylene terephthalate (melting point: 260° C.)

Sheath component: 25-mol % isophthalic acid copolymerized polyethylene terephthalate (melting point: 190° C.)

Core-sheath ratio (by weight): 70:30

Total decitex and number of filaments: 99 dtex and 24

Dry thermal shrinkage at 180° C.: 15%

Monofilament Yarn for Hook-Shaped Engaging Elements

Polyethylene terephthalate (melting point: 260° C.)

Fineness: 370 dtex (diameter: 0.19 mm)

Dry thermal shrinkage at 180° C.: 18%

Using the warp yarn, the weft yarn, and the monofilament yarn for hook-shaped engaging elements, a woven fabric for hook woven-fabric hook-and-loop fastener having a plain weave structure (sometimes also referred to simply as "woven fabric for hook-and-loop fastener") was produced by weaving as follows.

The warp yarn and the weft yarn were threaded so that the weave densities after a thermal shrinkage treatment were 55/cm for the warp yarn and 19/cm for the weft yarn. The monofilament yarn for hook-shaped engaging elements was threaded at a rate of one thread per four threads of the warp yarn in parallel to a warp yarn. The monofilament yarn for hook-shaped engaging elements alternately run over and under five threads of the weft yarn and then run over three threads of the warp yarn, and formed a loop at the running-over position.

The obtained woven fabric for hook-and-loop fastener had the following areas in order from one end to the other end parallel to the warp direction.

Selvage area with a width of 7.0 mm on one end,

Engaging element area with a width of 22.5 mm

Area for forming selvage with a width of 6.0 mm,

Engaging element area with a width of 22.5 mm

Area for forming selvage with a width of 6.0 mm,

Engaging element area with a width of 22.5 mm

Area for forming selvage with a width of 6.0 mm,

Engaging element area with a width of 22.5 mm

Selvage area with a width of 7.0 mm on the other end.

The obtained woven fabric for hook-and-loop fastener was subjected to a heat treatment by allowing the woven fabric to run through a heat treatment furnace for 55 seconds at 210° C., which was a temperature at which only the sheath component of the weft yarn was thermally molten and the warp yarn, the monofilament yarn for hook engaging elements, and the core component of the weft yarn were not thermally molten, without touching a solid substance and with little tension exerted, to cause shrinkage the weft yarn, the weft yarn, and the monofilament yarn for hook engaging elements. As a result, the woven fabric for hook-and-loop fastener was shrunk 11% in the weft direction, and the sheath component was molten and fused to nearby threads.

Subsequently, in the state where the heat-fusible fiber (sheath component) remained molten, as illustrated in FIG. 5, the woven fabric for hook-and-loop fastener was allowed to run for 5 seconds while pushing the rear surface thereof against a stainless-steel fixed surface having a pearskin-like (contact length with the rear surface: 5 cm) placed immediately after the outlet of the heat treatment furnace, and then, was allowed to run with a tension of 200 g/cm exerted.

After cooling, one leg portion of each of loops for hook-shaped engaging element was cut to form hook-shaped engaging elements, and then, the obtained hook woven-fabric hook-and-loop fastener was wound, and, in the wound state, was dyed with a crimson disperse dye liquid in the same manner as in Example 1.

The obtained hook woven-fabric hook-and-loop fastener had a hook-shaped engaging element density of 42/cm$^2$ and a height of the hook-shaped engaging elements from the base fabric front surface of 1.5 mm. Note that the step 1 of weaving the woven fabric for hook-and-loop fastener, the step 2 of heat treatment, the step 3 of pushing the rear surface against the fixed surface, and furthermore, the step of cutting one leg of each loop for hook-shaped engaging element were continuously performed without winding on the way, and the hook woven-fabric hook-and-loop fastener was wound for the first time after cutting one leg portion of each loop for hook-shaped engaging element.

The area for forming selvage interposed between the engaging element areas of the obtained hook woven-fabric hook-and-loop fastener was slitted at the center in the width direction in parallel to the warp yarn to obtain four 25-mm width long hook woven-fabric hook-and-loop fasteners with selvages which each had a 2.0-mm width selvage area on each of two opposite ends and had a 21-mm width engaging element area having hook-shaped engaging elements in a portion between the selvage areas. All the obtained four long hook woven-fabric hook-and-loop fasteners had no uneven dyeing and all the four were dyed into the same concentration. Observation of the dyed fasteners confirmed that a fiber cross section in the slitted portion had the same dyeing concentration as that of a fiber cross section of another portion.

As compared with a conventional hook woven-fabric hook-and-loop fastener formed of a nylon-type yarn with a back coating adhesive applied thereon, the obtained hook woven-fabric hook-and-loop fastener with selvages was superior in the softness and the widths of the selvage areas (including the selvage area obtained by slitting the area for forming selvage) were always a constant width of 2.0 mm, and there was no misalignment in the weft direction of the warp yarn. Accordingly, a problem in that the appearance of the hook woven-fabric hook-and-loop fastener worsens because a cut end of a warp yarn thread cut due to misalignment of a selvage area projects from an end of the selvage area did not occur. The engaging element surface of the hook woven-fabric hook-and-loop fastener was observed in detail. Then, in all the loops for hook-shaped engaging element, only one leg was securely cut at a position of the same height, and a loop with both the legs cut, a loop with no leg cut, a loop with a cut merely reaching the middle were never seen.

In the obtained hook woven-fabric hook-and-loop fastener, the warp yarn thickness Tb in the base fabric thickness direction at a point where the warp yarn was the most subducted toward the rear surface side and the warp yarn thickness Ts in the base fabric thickness direction at a point where the warp yarn was the most floated toward the front surface side were measured. Then, as shown in FIG. 3, Tb was 0.084 mm, Ts was 0.100 mm, and Tb/Ts was 0.84. The engaging force of the obtained hook woven-fabric hook-and-loop fastener was measured, and then the hook woven-fabric hook-and-loop fastener had an initial shear strength of 14.9 N/cm$^2$, an initial peeling strength of 1.15 N/cm, a shear strength after 1000 engagement/peeling operations of 13.6 N/cm$^2$, and a peeing strength after 1000 engagement/peeling operations of 1.05 N/cm. Thus, it was found that the hook woven-fabric hook-and-loop fastener had excellent engaging force as a woven-fabric hook-and-loop fastener.

The obtained hook woven-fabric hook-and-loop fastener was attached by sewing onto an upper fastening band of infant shoes as a fixture of a band for fastening an upper. Then, since the hook woven-fabric hook-and-loop fastener was soft and the selvage width was always constant, the hook woven-fabric hook-and-loop fastener could be attached with good appearance with the sawing threads running in parallel to the selvages.

Example 3: Hook/Loop Coexisting Woven-Fabric Hook-and-Loop Fastener

As a warp yarn, a weft yarn, a multifilament yarn for loop-shaped engaging elements, and a monofilament yarn for hook-shaped engaging elements forming a hook/loop coexisting woven-fabric hook-and-loop fastener, the following yarns were used.

Warp Yarn
- Multifilament yarn of polyethylene terephthalate having a melting point of 260° C.
- Total decitex and number of filaments: 167 dtex and 30
- Dry thermal shrinkage at 180° C.: 16%

Weft Yarn: Multifilament Yarn of Heat-Fusible Sheath-Core-Type Fiber
- Core component: polyethylene terephthalate (melting point: 260° C.)
- Sheath component: 25-mol % isophthalic acid copolymerized polybutylene terephthalate (melting point: 185° C.)
- Core-sheath ratio (by weight): 70:30
- Total decitex and number of filaments: 110 dtex and 24
- Dry thermal shrinkage at 180° C.: 15%

Multifilament Yarn for Loop-Shaped Engaging Elements
- Polybutylene terephthalate fiber (melting point: 220° C.)
- Total decitex and number of filaments: 305 dtex and 8
- Dry thermal shrinkage at 180° C.: 14%

Monofilament Yarn for Hook-Shaped Engaging Elements
- Polyethylene terephthalate (melting point: 260° C.)
- Fineness: 370 dtex (diameter: 0.19 mm)
- Dry thermal shrinkage at 180° C.: 18%

Using the warp yarn, the weft yarn, the multifilament yarn for loop-shaped engaging elements, and the monofilament yarn for hook-shaped engaging elements, a woven fabric for hook woven-fabric hook-and-loop fastener having a plain weave structure (sometimes also referred to simply as "woven fabric for hook-and-loop fastener") was produced by weaving as follows.

The warp yarn and the weft yarn were threaded so that the weave densities after a thermal shrinkage treatment were 55/cm for the warp yarn and 19/cm for the weft yarn.

The multifilament yarn for loop-shaped engaging elements was threaded at a rate of one thread per four threads of the warp yarn in parallel to the warp yarn so as to alternately run over and under three threads of the weft yarn and then run over one thread of the warp yarn, and formed a loop at the running-over position on the woven base fabric.

The monofilament yarn for hook-shaped engaging elements was threaded at a rate of one thread per four threads of the warp yarn in parallel to a warp yarn so as to alternately run over and under three threads of the weft yarn and then run over three threads of the warp yarn, and formed a loop at the running-over position on the woven base fabric.

The multifilament yarn for loop-shaped engaging elements and the monofilament yarn for hook-shaped engaging elements were threaded in an alternate manner so that two-thread units of the multifilament yarn for loop-shaped engaging elements and two-thread units of the monofilament yarn for hook-shaped engaging elements were continuously present.

The obtained woven fabric for hook-and-loop fastener had the following areas in order from one end to the other end parallel to the warp direction.

Selvage area with a width of 7.0 mm on one end,
Engaging element area with a width of 22.5 mm
Area for forming selvage with a width of 6.0 mm,
Engaging element area with a width of 22.5 mm
Area for forming selvage with a width of 6.0 mm,
Engaging element area with a width of 22.5 mm
Area for forming selvage with a width of 6.0 mm,
Engaging element area with a width of 22.5 mm
Selvage area with a width of 7.0 mm on the other end.

The obtained 12.2-cm width woven fabric for hook-and-loop fastener was subjected to a heat treatment by allowing the woven fabric to run through a heat treatment furnace for 60 seconds at 205° C., which was a temperature at which only the sheath component of the weft yarn was thermally molten and the warp yarn, the yarn for engaging elements, and the core component of the weft yarn were not thermally molten, with little tension exerted to cause shrinkage the warp yarn, the weft yarn, and the yarn for engaging elements. As a result, the woven fabric for hook-and-loop fastener was shrunk 11% in the weft direction, and the sheath component was molten and fused to nearby threads.

Subsequently, in the state where the heat-fusible fiber (sheath component) remained molten, in the same manner as in Example 1, the woven fabric for hook-and-loop fastener was allowed to run for 5 seconds while pushing the rear surface thereof against a stainless-steel fixed surface having a pearskin-like surface (contact length with the rear surface: 5 cm) placed immediately after the outlet of the heat treatment furnace, and then, was allowed to run with a tension of 200 g/cm exerted.

After cooling, one leg portion of each of loops for hook-shaped engaging element was cut to form hook-shaped engaging elements, and then, the obtained hook/loop coexisting woven-fabric hook-and-loop fastener was wound, and, in the wound state, was dyed with a crimson disperse dye liquid in the same manner as in Example 2.

The obtained hook/loop coexisting woven-fabric hook-and-loop fastener had a hook-shaped engaging element density of 30/cm$^2$, a loop-shaped engaging element density of 30/cm$^2$, a height of the hook-shaped engaging elements from the base fabric front surface of 1.6 mm, and a height of the loop-shaped engaging elements from the base fabric of 2.0 mm. Note that the step 1 of weaving the woven fabric, the step 2 of heat treatment, the step 3 of pushing the rear surface against the fixed surface, and furthermore, the step of cutting one leg of each loop for hook-shaped engaging element were continuously performed without winding on the way.

The area for forming selvage interposed between the engaging element areas of the obtained hook/loop coexisting woven-fabric woven fabric for hook-and-loop fastener was slitted at the center in the width direction in parallel to a warp yarn to obtain four 25-mm width long hook/loop coexisting woven-fabric hook-and-loop fasteners with selvages which each had a 2.0-mm width selvage area on each of two opposite ends and had a 21-mm width engaging element area having hook-shaped engaging elements and loop-shaped engaging elements in a portion between the selvage areas. All the obtained four long hook/loop coexisting woven-fabric hook-and-loop fasteners had no uneven dyeing and all the four were dyed into the same concentration. Observation of the dyed fasteners confirmed that a fiber cross section in the slitted portion had the same dyeing concentration as that of a fiber cross section of another portion as with the case of Examples 1 and 2.

As compared with a conventional hook/loop coexisting woven-fabric hook-and-loop fastener formed of a nylon-type yarn with a back coating adhesive applied thereon, the obtained hook/loop coexisting woven-fabric hook-and-loop fastener with selvages was superior in the softness and the widths of the selvage areas (including the selvage area obtained by slitting the area for forming selvage) were always a constant width of 2.0 mm, and there was no misalignment in the weft direction of the warp yarn. Thus, a problem in that the appearance of the woven-fabric hook-and-loop fastener worsens because a cut end of a warp yarn thread cut due to misalignment of a selvage area projects from an end of the selvage area did not occur. The hook-shaped engaging elements of the hook/loop coexisting woven-fabric hook-and-loop fastener were observed in detail, and then, for all the hook-shaped engaging elements, only one leg was completely cut at a position of the same height, and a loop with both the legs cut, a loop with no leg not cut, a loop with a cut merely reaching the middle were never seen.

In the obtained hook/loop coexisting woven-fabric hook-and-loop fastener, the warp yarn thickness Tb in the base fabric thickness direction at a point where the warp yarn was the most subducted toward the rear surface side and the warp yarn thickness Ts in the base fabric thickness direction at a point where the warp yarn was the most floated toward the front surface side were measured. Then, Tb was 0.087 mm, Ts was 0.102 mm, and Tb/Ts was 0.85.

The engaging force of the obtained hook/loop coexisting woven-fabric hook-and-loop fastener was measured, and then the hook/loop coexisting woven-fabric hook-and-loop fastener had an initial shear strength of 11.1 N/cm$^2$, an initial peeling strength of 1.05 N/cm, a shear strength after 1000 engagement/peeling operations of 10.0 N/cm$^2$, and a peeling strength after 1000 engagement/peeling operations of 0.96 N/cm. Thus, it was found that the hook/loop coexisting woven-fabric hook-and-loop fastener had excellent engaging force as a hook/loop coexisting woven-fabric hook-and-loop fastener. The obtained hook/loop coexisting woven-fabric hook-and-loop fastener was attached by sewing onto a supporter as a tape for fastening supporter. Then, the hook/loop coexisting woven-fabric hook-and-loop fastener was soft, and since the selvage width was always constant, the hook/loop coexisting woven-fabric hook-and-loop fastener could be attached with good appearance without meandering of a sewing thread. The supporter was allowed to pass through a cylinder, one end thereof was fold back, and the hook/loop engaging element surfaces were allowed to engage with each other, whereby it was found that the fastening force was sufficient.

Comparative Example 1

Four 25-mm width long loop woven-fabric hook-and-loop fasteners with selvages which had a 2.0-mm width selvage area on each of two opposite ends and had a 21-mm width engaging element area in a portion between the selvage areas was obtained in the same manner as in Example 1 except for not performing the step 3, but cooling the heat-treated woven fabric for hook-and-loop fastener obtained in the step 2, and then taking the woven fabric by drawing with a roller. The obtained four long loop woven-fabric hook-and-loop fasteners had uneven dyeing, although slight, in the length direction, and particularly in two obtained by slitting the areas for forming selvage near the two opposite ends, uneven dyeing was seen in several points.

In the selvage area obtained by slitting the area for forming selvage of the loop woven-fabric hook-and-loop fastener with selvages, a portion with a larger selvage width and a portion with a smaller selvage width on the basis of a selvage width of 2.0 mm are present at 0.6 cm intervals in the warp direction. Furthermore, a cut end of a cut warp yarn thread projected from an end of a selvage area, which looked like a fray, leading to a bad appearance of the woven-fabric hook-and-loop fastener.

In addition, the selvage area present before slitting misaligned in the weft direction, and as a result, the selvage width was uneven. Tb and Ts were measured, and then, as illustrated in FIG. 4, Tb was 0.101 mm, Ts was 0.104 mm, and Tb/Ts was 0.97.

The engaging force of the loop woven-fabric hook-and-loop fastener was measured. Then, the loop woven-fabric hook-and-loop fastener has an initial shear strength of 14.2 N/cm$^2$, an initial peeling strength of 1.09 N/cm, a shear strength after 1000 engagement/peeling operations of 12.9 N/cm$^2$, and a peeling strength after 1000 engagement/peeling operations of 0.99 N/cm. Thus, it was found that the loop woven-fabric hook-and-loop fastener had excellent engaging force as a woven-fabric hook-and-loop fastener to some extent. The selvage area of the loop woven-fabric hook-and-loop fastener with selvages was attached by sewing onto a fabric, and then, the sewing thread looked meandering and the loop woven-fabric hook-and-loop fastener was inferior to Example 1 in terms of the appearance.

Comparative Example 2

Four 25-mm width long hook woven-fabric hook-and-loop fasteners with selvages which had a 2.0-mm width selvage area on each of two opposite ends and had a 21-mm width engaging element area in a portion between the selvage areas were obtained in the same manner as in Example 2 except for not performing the step 3, but cooling the heat-treated woven fabric for hook-and-loop fastener obtained in the step 2, and then taking the wove fabric by drawing with a roller. As with the case of Comparative Example 1, the obtained four long hook woven-fabric hook-and-loop fasteners had uneven dyeing, although slight, in the length direction, and particularly in two obtained by slitting the areas for forming selvage near two opposite ends, uneven dyeing was seen in several points.

In the selvage area obtained by slitting the area for forming selvage of the hook woven-fabric hook-and-loop fastener with selvage, a portion with a larger selvage width and a portion with a smaller selvage width on the basis of a selvage width of 2.0 mm are present. Furthermore, a cut end of a cut warp yarn thread projected from an end of a selvage area, which looked like a fray, leading to a bad appearance of the woven-fabric hook-and-loop fastener.

Furthermore, the hook-shaped engaging elements present on the front surface of the hook woven-fabric hook-and-loop fastener were observed under magnification, and then, it was found that there were a small number of loops without a leg cut, loops with both legs cut, loops with a leg cut at a position near the root, or loops with a leg cut at a position away from the root.

In addition, the selvage area present before slitting misaligned in the weft direction, and as a result, the selvage width was uneven.

Tb and Ts were measured, and then, as illustrated in FIG. 4, Tb was 0.098 mm, Ts was 0.100 mm, and Tb/Ts was 0.98.

The engaging force of the hook woven-fabric hook-and-loop fastener was measured. Then, the hook woven-fabric hook-and-loop fastener had an initial shear strength of 13.4 N/cm$^2$, an initial peeling strength of 1.04 N/cm, a shear strength after 1000 engagement/peeling operations of 12.2 N/cm$^2$, and a peeling strength after 1000 engagement/peeling operations of 0.94 N/cm. Thus, it was found that the hook woven-fabric hook-and-loop fastener was inferior to the hook woven-fabric hook-and-loop fastener of Example 2 in terms of the engaging force.

The selvage area of the hook woven-fabric hook-and-loop fastener with selvages was attached by sewing onto a fabric in the same manner as in Comparative Example 1, and then, the sewing thread looked meandering, and the loop woven-fabric hook-and-loop fastener was inferior to Example 2 in terms of the appearance.

Comparative Example 3

Four 25-mm width long hook/loop coexisting woven-fabric hook-and-loop fasteners with selvages which had a 2.0-mm width selvage area on each of two opposite ends and had a 21-mm width engaging element area in a portion between the selvage areas were obtained in the same manner as in Example 3 except for not performing the step 3, but cooling the woven fabric for hook-and-loop fastener, then taking the woven fabric by drawing with a guide on a fixed surface, and then, performing a one-leg cutting treatment of loops for hook-shaped engaging element. As with the case of Comparative Examples 1 and 2, the obtained four long hook/loop coexisting woven-fabric hook-and-loop fasteners had uneven dyeing, although slight, in the warp direction, and particularly in two obtained by slitting the areas for forming selvage near two opposite ends, uneven dyeing was seen in several points.

In the selvage area obtained by slitting the area for forming selvage of the hook/loop coexisting woven-fabric hook-and-loop fastener with selvages, a portion with a larger selvage width and a portion with a smaller selvage width are present together, and furthermore, a cut end of a cut warp yarn thread projected from an end of a selvage area, which looked like a fray, leading to a bad appearance of the woven-fabric hook-and-loop fastener.

In addition, the selvage area present before slitting misaligned in the weft direction, and as a result, the selvage width was uneven.

The hook-shaped engaging elements present on the front surface of the hook/loop coexisting woven-fabric hook-and-loop fastener were observed under magnification, and then, as with the case of Comparative Example 2, there were a small number of loops without a leg cut, loops with both legs cut, loops with a leg cut at a position near the root, or loops with a leg cut at a position away from the root.

Tb and Ts were measured, and then, as illustrated in FIG. 4, Tb was 0.099 mm. Ts was 0.102 mm, and Tb/Ts was 0.97.

The engaging force of the hook/loop coexisting woven-fabric hook-and-loop fastener was measured. Then, the hook/loop coexisting woven-fabric hook-and-loop fastener had an initial shear strength of 10.0 N/cm$^2$, an initial peeling strength of 0.95 N/cm, a shear strength after 1000 engagement/peeling operations of 9.0 N/cm$^2$, and a peeling strength after 1000 engagement/peeling operations of 0.86 N/cm, and thus, it was found that the hook/loop coexisting woven-fabric hook-and-loop fastener has poorer engaging force than that of the hook/loop coexisting woven-fabric hook-and-loop fastener of Example 3.

The selvage area of the hook/loop coexisting woven-fabric hook-and-loop fastener with selvages was attached by sewing onto a fabric in the same manner as in Comparative Examples 1 and 2, and then, a sewing thread looked meandering in the warp direction, and the loop woven-fabric hook-and-loop fastener was inferior to Example 3 in terms of the appearance.

Example 4

Four 25-mm width long hook woven-fabric hook-and-loop fasteners with selvages which had a 2.0-mm width selvage area on each of two opposite ends and had a 21-mm width engaging element area having hook-shaped engaging elements in a portion between the selvage areas were produced in the same manner as in Example 2 except for replacing the stainless-steel fixed surface having a pearskin-like surface used in the step 3 in Example 2 with a stainless-steel mirror-finished rolling surface. Note that the rolling surface rotates according to the running rate of the woven fabric for hook-and-loop fastener which runs in contact therewith. The contact time of the woven base fabric rear surface and the rolling surface was 5 seconds, and the rear surface was pushed against the rolling surface in the state where the heat-fusible fiber (sheath component) remained molten. After passing the rolling surface, the woven base fabric was under a tension of 250 g/cm.

The obtained four long hook woven-fabric hook-and-loop fasteners had no uneven dyeing, and all the four were dyed into the same concentration. Observation of the dyed fastener confirmed that a fiber cross section in the slitted portion had the same dyeing concentration as that of a fiber cross section of another portion as with the case of Examples 1 to 3.

As compared with a conventional woven-fabric hook-and-loop fastener formed of a nylon-type yarn with a back coating adhesive applied thereon, the obtained hook woven-fabric hook-and-loop fastener with selvages was superior in the softness as with Example 2. In addition, the selvage areas obtained by slitting the area for forming selvage as well as the selvage areas present before slitting always had a constant selvage width of 2.0 mm. There is no misalignment in the weft direction of the warp yarn, and a cut end of a warp yarn thread cut due to misalignment was not seen on the selvage area end. The engaging element surface of the hook woven-fabric hook-and-loop fastener was observed in detail, and then, in all the loops for hook-shaped engaging element, only one leg was accurately cut at a position of the same height as with the case of Example 2.

Tb and Ts were measured, and then, as illustrated in FIG. 4, Tb was 0.091 mm, Ts was 0.100 mm, and Tb/Ts was 0.91.

The engaging force of the hook woven-fabric hook-and-loop fastener was measured. Then, the hook woven-fabric hook-and-loop fastener had an initial shear strength of 14.8 $N/cm^2$, an initial peeling strength of 1.10 N/cm, a shear strength after 1000 engagement/peeling operations of 13.5 $N/cm^2$, and a peeling strength after 1000 engagement/peeling operations of 1.00 N/cm, and thus, it was found that the hook woven-fabric hook-and-loop fastener had excellent engaging force as a hook woven-fabric hook-and-loop fastener.

The obtained hook woven-fabric hook-and-loop fastener was attached by sewing as a fixture for fastening a sleeve opening of sport globes, and then, the hook woven-fabric hook-and-loop fastener had such a softness that the fastener bended according to the motion of a hand, and since the selvage width was always constant, the fastener could be attached with good appearance with the sewing thread running in parallel to the selvage.

REFERENCE SIGNS LIST

1: engaging element area
2*a*: selvage area
2*b*: area for forming selvage (area for intermediate selvage)
3: warp yarn
4: weft yarn
5: engaging element
L: loop for engaging element
K: base fabric thickness direction
6: woven fabric for hook-and-loop fastener
7: heat treatment furnace
8: fixed surface or rolling surface
Wa: warp direction
We: weft direction
Tb: warp yarn thickness in the base fabric thickness direction at a point where the warp yarn is the most subducted toward the rear surface side
Ts: warp yarn thickness in the base fabric thickness direction at a point where the warp yarn is the most floated toward the front surface side

The invention claimed is:

1. A polyester woven-fabric hook-and-loop fastener, comprising:
a woven base fabric formed of a warp yarn and a weft yarn, and
a yarn for engaging elements, woven in parallel to the warp yarn of the base fabric,
the yarn for engaging elements forming a number of loop-shaped engaging elements, hook-shaped engaging elements, or both that rise up from a front surface of the base fabric,
each of the warp yarn, the weft yarn, and the yarn for engaging elements being of a polyester fiber,
the weft yarn containing a heat-fusible fiber,
the engaging elements each being fused at a root thereof to the heat-fusible fiber to thus be fixed to the base fabric, and
the polyester woven-fabric hook-and-loop fastener satisfying requirements (1) and (2) described below:
(1) the warp yarn alternately runs over and under the weft yarn with the weft yarn interposed therebetween, and a thickness Tb thereof in a base fabric thickness direction at a point where the warp yarn is the most subducted toward a base fabric rear surface side is 0.94 times or less a thickness Ts thereof in the base fabric thickness direction at a point where the warp yarn is the most floated toward a base fabric front surface side, and
(2) a selvage area having no engaging elements is present continuously in a warp direction on each of two opposite ends parallel to the warp yarn on the base fabric front surface side.

2. The polyester woven-fabric hook-and-loop fastener according to claim 1, wherein Tb is 0.92 times Ts or less.

3. The polyester woven-fabric hook-and-loop fastener according to claim 1, wherein Tb is in the range of 0.7 to 0.88 times Ts.

4. The polyester woven-fabric hook-and-loop fastener according to claim 1, wherein an area for forming selvage having no engaging elements is present continuously in the warp direction between the selvage areas on the two opposite ends, and an area having engaging elements is divided by the area for forming selvage into two or more areas parallel to the warp direction.

5. The polyester woven-fabric hook-and-loop fastener according to claim 4, wherein the area for forming selvage is slitted at a center in a width direction in parallel to the warp direction to form selvage areas.

6. The polyester woven-fabric hook-and-loop fastener according to claim 1, wherein no adhesive layer for fixing the engaging elements onto the base fabric is present on a base fabric rear surface.

7. The polyester woven-fabric hook-and-loop fastener according to claim 1, which is dyed with a disperse dye.

8. A method of producing the polyester woven-fabric hook-and-loop fastener according to claim 1, the method comprising (1) to (3) to be performed in this order:
(1): weaving a woven fabric for hook-and-loop fastener, the woven fabric including
the woven base fabric formed of the warp yarn and the weft yarn,
the yarn for engaging elements, woven in parallel to the warp yarn of the base fabric, and
the selvage area having no engaging elements, the selvage area being present on each of two opposite ends of the base fabric front surface and being present continuously in parallel to a warp direction,
the yarn for engaging elements forming a number of loops for hook-shaped engaging element, loops for loop engaging element, or both that rise up from the base fabric front surface,
each of the warp yarn, the weft yarn, and the yarn for engaging elements being of a polyester fiber, and
the weft yarn containing the heat-fusible fiber;
(2): heating the woven fabric for hook-and-loop fastener in a heat treatment furnace to a temperature at which the heat-fusible fiber melts or higher to cause thermal shrinkage of a yarn constituting the woven fabric for hook-and-loop fastener while strongly fixing the yarn for engaging elements to the base fabric; and
(3): taking the heat-treated woven fabric for hook-and-loop fastener out of the heat treatment furnace and pushing a rear surface of the base fabric against a fixed surface or a rolling surface in the state where the heat-fusible fiber remains molten.

9. The production method according to claim 8, wherein the woven fabric for hook-and-loop fastener obtained in (1) has, between the selvage areas, an area for forming selvage having no engaging elements continuously formed in the warp direction, and an area having engaging elements is divided by the area for forming selvage into two or more areas parallel to the warp direction.

10. The production method according to claim 8, wherein (1) to (3) are continuously performed without winding on the way.

11. The production method according to claim 8, wherein (3) is performed without pushing a front surface side of the base fabric onto a fixed surface or a rolling surface.

12. The production method according to claim 8, wherein the yarn for engaging elements forms loops for hook-shaped engaging element or both of loops for hook-shaped engaging element and loops for loop engaging element, and wherein (4) described below is performed after (3), and (1) to (4) are continuously performed without winding on the way:

(4): cutting one leg of each of the loops for hook-shaped engaging element to form hook-shaped engaging elements.

13. The production method according to claim 9, wherein the woven fabric for hook-and-loop fastener has an area for forming selvage, and wherein (5) described below is performed, after completion of (3) when the yarn for engaging elements forms loops for loop engaging element, or after completion of (4) when the yarn for engaging elements forms loops for hook-shaped engaging element or both of loops for hook-shaped engaging element and loops for loop engaging element:

(5): slitting the area for forming selvage at a center in a width direction in parallel to the warp direction.

14. The production method according to claim 8, wherein the obtained polyester woven-fabric hook-and-loop fastener is wound, after completion of (3) when the yarn for engaging elements forms loops for loop engaging element, or after completion of (4) when the yarn for engaging elements forms loops for hook-shaped engaging element or both of loops for hook-shaped engaging element and loops for loop engaging element, and the polyester woven-fabric hook-and-loop fastener is immersed in the wound state in a dyeing liquid containing a disperse dye to dye the hook-and-loop fastener.

15. The production method according claim 9, wherein the obtained polyester woven-fabric hook-and-loop fastener having an area for forming selvage is wound, after completion of (3) when the yarn for engaging elements forms loops for loop engaging element, or after completion of (4) when the yarn for engaging elements forms loops for hook-shaped engaging element or both of loops for hook-shaped engaging element and loops for loop engaging element, and the polyester woven-fabric hook-and-loop fastener is immersed in the wound state in a dyeing liquid containing a disperse dye to dye the hook-and-loop fastener.

16. The production method according to claim 15, wherein (5) described below is performed after the dyeing:

(5): slitting the area for forming selvage at a center in a width direction in parallel to the warp direction.

* * * * *